US008590324B2

(12) United States Patent
Guo et al.

(10) Patent No.: US 8,590,324 B2
(45) Date of Patent: Nov. 26, 2013

(54) COMPRESSOR AND OIL-COOLING SYSTEM

(75) Inventors: Weihua Guo, Suzhou (CN); Honghong Zhan, Suzhou (CN); Shi Wang, Suzhou (CN); Huaming Guo, Suzhou (CN); Guibin Wang, Suzhou (CN); Jin Zhang, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 680 days.

(21) Appl. No.: 12/776,773

(22) Filed: May 10, 2010

(65) Prior Publication Data

US 2010/0307173 A1 Dec. 9, 2010

Related U.S. Application Data

(60) Provisional application No. 61/178,720, filed on May 15, 2009.

(51) Int. Cl.
*F25B 43/02* (2006.01)

(52) U.S. Cl.
USPC ..... 62/84; 62/468

(58) Field of Classification Search
USPC ..... 62/84, 98, 190, 192, 467, 468, 470, 62/513; 417/13, 372; 418/55.6, 83, 102; 165/104.21, 174
See application file for complete search history.

(56) References Cited

U.S. PATENT DOCUMENTS

| | | | | |
|---|---|---|---|---|
| 3,176,913 A | | 4/1965 | Sorg et al. | |
| 3,710,590 A | * | 1/1973 | Kocher | 62/468 |
| 3,759,348 A | | 9/1973 | Kasahara | |
| 3,856,493 A | * | 12/1974 | Bulkley | 62/401 |
| 4,062,199 A | | 12/1977 | Kasahara et al. | |
| 4,889,471 A | * | 12/1989 | Izunaga et al. | 417/32 |
| 5,050,392 A | * | 9/1991 | Messmer et al. | 62/114 |
| 5,222,874 A | * | 6/1993 | Unnewehr et al. | 417/372 |
| 5,433,590 A | | 7/1995 | Klaus et al. | |
| 5,887,441 A | * | 3/1999 | Spauschus et al. | 62/84 |
| 6,017,205 A | * | 1/2000 | Weatherston et al. | 418/55.6 |
| 6,058,727 A | | 5/2000 | Fraser, Jr. et al. | |
| 6,065,297 A | * | 5/2000 | Tischer et al. | 62/84 |

(Continued)

FOREIGN PATENT DOCUMENTS

| | | |
|---|---|---|
| CN | 1969281 A | 5/2007 |
| CN | 101033805 A | 9/2007 |

(Continued)

OTHER PUBLICATIONS

Search Report from the Chinese Patent Office regarding Application No. 201010184593.3, issued Jan. 18, 2013.

First Chinese Office Action regarding Application No. 201010184593.3 dated Jan. 28, 2013.

*Primary Examiner* — Mohammad M Ali

(74) *Attorney, Agent, or Firm* — Harness, Dickey & Pierce, P.L.C.

(57) ABSTRACT

An external heat exchanger is used to transfer heat from a compressor lubricant to an expanded working fluid, thereby cooling the lubricant. The heat exchanger may also be used to sub-cool condensed working fluid with the same flow of expanded working fluid. A horizontal scroll-type compressor includes an intermediate lubricant sump between a main bearing support and a scroll member. A counterweight on the crankshaft can travel through the lubricant in the intermediate sump to splash the lubricant around. A horizontal scroll-type compressor can include multiple machined surfaces that are utilized to precisely center and align components of the compressor.

24 Claims, 19 Drawing Sheets

(56) References Cited

U.S. PATENT DOCUMENTS

| | | | | |
|---|---|---|---|---|
| 6,145,326 | A | 11/2000 | O'Brien | |
| 6,182,467 | B1 * | 2/2001 | Zhong et al. | 62/470 |
| 6,457,325 | B1 * | 10/2002 | Vetter | 62/473 |
| 2005/0022551 | A1 * | 2/2005 | Barratt et al. | 62/471 |
| 2008/0078204 | A1 * | 4/2008 | Ignatiev | 62/512 |
| 2008/0232991 | A1 * | 9/2008 | Masuda | 418/59 |

FOREIGN PATENT DOCUMENTS

| | | | |
|---|---|---|---|
| CN | 101432385 | A | 5/2009 |
| EP | 0924478 | A2 | 6/1999 |
| JP | 2007093086 | A | 4/2007 |

* cited by examiner

COMPRESSOR AND OIL-COOLING SYSTEM

CROSS-REFERENCE TO RELATED APPLICATIONS

This application claims the benefit of U.S. Provisional Application No. 61/178,720, filed on May 15, 2009. The entire disclosure of the above application is incorporated herein by reference.

FIELD OF THE INVENTION

The present invention relates generally to compressor machines. More particularly, the present invention relates to a compressor and an oil-cooling system that cools the lubricating oil that flows through the compressor.

BACKGROUND AND SUMMARY OF THE INVENTION

Compressor machines in general, and particularly scroll compressors, are often disposed in a hermetic or semi-hermetic shell which defines a chamber within which is disposed a working fluid. A partition within the shell often divides the chamber into a discharge-pressure zone and a suction-pressure zone. In a low-side arrangement, a scroll assembly is located within the suction-pressure zone for compressing the working fluid. Generally, these scroll assemblies incorporate a pair of intermeshed spiral wraps, one or both of which are caused to orbit relative to the other so as to define one or more moving chambers which progressively decrease in size as they travel from an outer suction port towards a center discharge port. An electric motor is normally provided which operates to cause this relative orbital movement.

The partition within the shell allows compressed fluid exiting the center discharge port of the scroll assembly to enter the discharge-pressure zone within the shell while simultaneously maintaining the integrity between the discharge-pressure zone and the suction-pressure zone. This function of the partition is normally accomplished by a seal which interacts with the partition and with the scroll member defining the center discharge port.

The discharge-pressure zone of the shell is normally provided with a discharge-fluid port which communicates with a refrigeration circuit or some other type of fluid circuit. In a closed system, the opposite end of the fluid circuit is connected with the suction-pressure zone of the shell using a suction-fluid port extending through the shell into the suction-pressure zone. Thus, the scroll machine receives the working fluid from the suction-pressure zone of the shell, compresses the working fluid in the one or more moving chambers defined by the scroll assembly, and then discharges the compressed working fluid into the discharge-pressure zone of the compressor. The compressed working fluid is directed through the discharge port through the fluid circuit and returns to the suction-pressure zone of the shell through the suction port.

A lubricant (e.g., oil) sump can be employed in the shell of the compressor to store the lubricant charge. The sump can be placed in either the low-pressure zone or the high-pressure zone. The lubricant serves to lubricate the moving components of the compressor and can flow with the working fluid through the scroll assemblies and be discharged along with the working fluid into the discharge-pressure zone of the compressor. The temperature of the lubricant being discharged, along with that of the working fluid, is elevated. Cooling the lubricant prior to flowing back through the compressor and lubricating the components therein can reduce suction-gas superheat, thereby improving compressor volumetric efficiency and providing better performance. The reduced lubricant temperature may also improve compressor reliability by cooling the suction gas and the motor. Cooling the lubricant can also keep the viscosity of the lubricant at a desirable level for maintaining oil film thickness between moving parts.

Within the compressor, the lubricant is provided to the various moving components. Improving the distribution of the lubricant throughout the compressor can advantageously improve the performance and/or longevity of the compressor.

Within the compressor, the proper alignment of the various components relative to one another can improve the performance of the compressor and/or reduce the sound generated by the compressor. Improving the alignment between the various components, such as the non-orbiting scroll member, the bearings, and the motor, can improve the performance and/or reduce the sound generated by the compressor. The compressors typically use numerous discrete components that are assembled together within the shell to provide the alignment. The use of these numerous separate and discrete components, however, increases the potential for inaccuracy in the alignment of the components and, further, can be more expensive or time consuming to manufacture as tighter tolerances for the various components are required to produce the desired alignment.

In one form, the present disclosure provides a system that may include a compressor, a lubricant, a condenser, an expansion device, and a heat exchanger. The compressor may compress a working fluid from a suction pressure to a discharge pressure greater than the suction pressure. The lubricant may lubricate the compressor. The condenser may condense working fluid discharged by the compressor. The expansion device may expand working fluid condensed by the condenser. The heat exchanger may transfer heat from the lubricant to expanded working fluid.

In another form, the present disclosure provides a compressor that may include a shell, a compression mechanism, a crankshaft, a bearing, and a lubricant sump. The compression mechanism may be disposed in the shell and compressing a working fluid. The crankshaft may be disposed at least partially in the shell and drivingly engaged with the compression mechanism. The bearing support may rotatably support the crankshaft. The lubricant sump may retain a volume of lubricant and disposed between the bearing support and the compression mechanism.

In yet another form, the present disclosure provides a compressor that may include a unitary body including a shell unitarily formed with a main bearing support. The main bearing support may include a bore for supporting a portion of a crankshaft. The shell may include a continuous annular surface on an interior of the shell adjacent a first end of the shell and a plurality of axially extending arcuate surfaces adjacent a second end of the shell. The plurality of arcuate surfaces being spaced apart along the interior of the shell.

The compressor may also include a scroll member having a peripheral exterior surface dimensioned to fit inside of the first end of the shell and engage the annular surface. The annular surface may center the scroll member in the shell.

The compressor may also include a partition plate having a rim dimensioned to fit inside of the first end of the shell and engage the annular surface. The annular surface may center the partition plate relative to the shell.

The compressor may also include an end cap having a rim dimensioned to fit inside of the second end of the shell and engage the arcuate surfaces. The end cap may have a bore for supporting an end portion of the crankshaft. The arcuate surfaces centering the end cap relative to the shell and axially aligning the bore in the end cap with the bore in the main bearing support.

The compressor may also include a stator having an exterior surface dimensioned to be received in the shell. The exterior surface may engage the arcuate surfaces. The arcuate surface may center the stator in the shell.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1A:
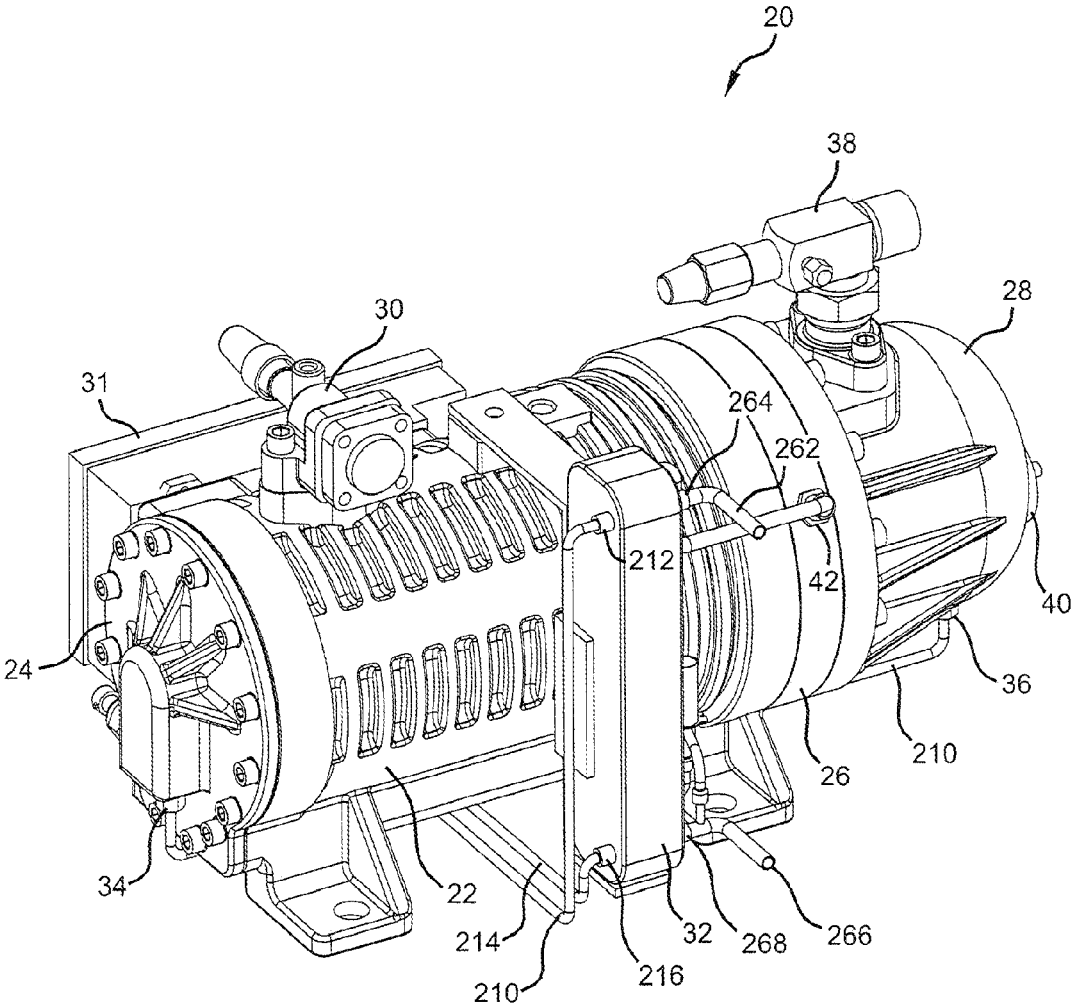
FIGS. 1A-C are perspective views of a compressor according to the present teachings.

The following description is merely exemplary in nature and is in no way intended to limit the present disclosure, its application, or uses.

Referring to FIGS. 1-3 and 10, a compressor 20 according to the present teachings is shown. Compressor 20 is a semi-hermetic compressor having a housing or shell 22 with opposite ends 23, 25. A low-side (LS) end cap 24 is attached to end 23 and a partition member 26 and a high-side (HS) end cap 28 are attached to end 25. LS end cap 24, partition 26, and HS end cap 28 can be attached to shell 22 with bolts or other types of fasteners, as known in the art. Other major elements affixed to shell 22 can include a working fluid inlet fitting 30, a heat exchanger 32, and an electronics box 31 that can communicate with sensors and other components within or outside compressor 20. LS end cap 24 includes a lubricant inlet fitting 34. HS end cap 28 may define a high-side lubricant sump and includes a lubricant outlet fitting 36. HS end cap 28 can also include a working fluid discharge fitting 38 and a sight gauge 40. Partition 26 can include a fluid injection inlet fitting 42 that communicates with an intermediate-pressure location in the compression members of the compressor, as described below. HS end cap 28 and partition 26 define a discharge chamber 46, while LS end cap 24, shell 22, and partition 26 define a suction or intake chamber 48.

Referring to FIGS. 2-4 and 11, shell 22 is a single integral component or piece that can have various features machined therein. By way of non-limiting example, shell 22 can be a cast component. Various features are machined into shell 22 to provide precise alignment for the internal components to be assembled therein. Shell 22 includes a main bearing support 50 with a precision machined central opening 52 therein. Opening 52 is configured to receive a main bearing or bushing 54 to support an intermediate portion of a crankshaft 56. Bearing 54 can be press fit into opening 52.

Figure 3A:
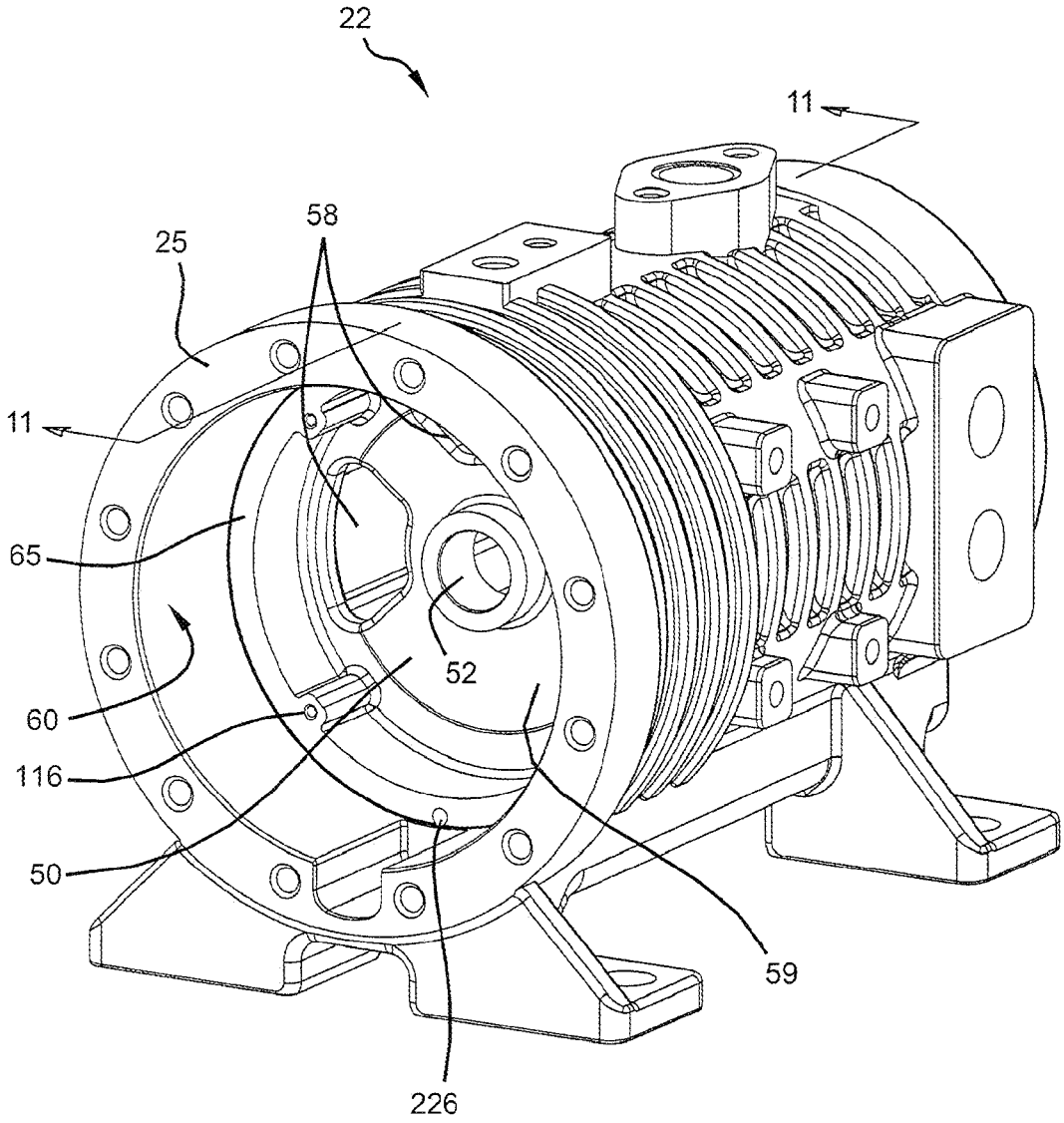
FIGS. 3A and 3B are perspective views of the shell of the compressor of FIG. 1.
Figure 3B:
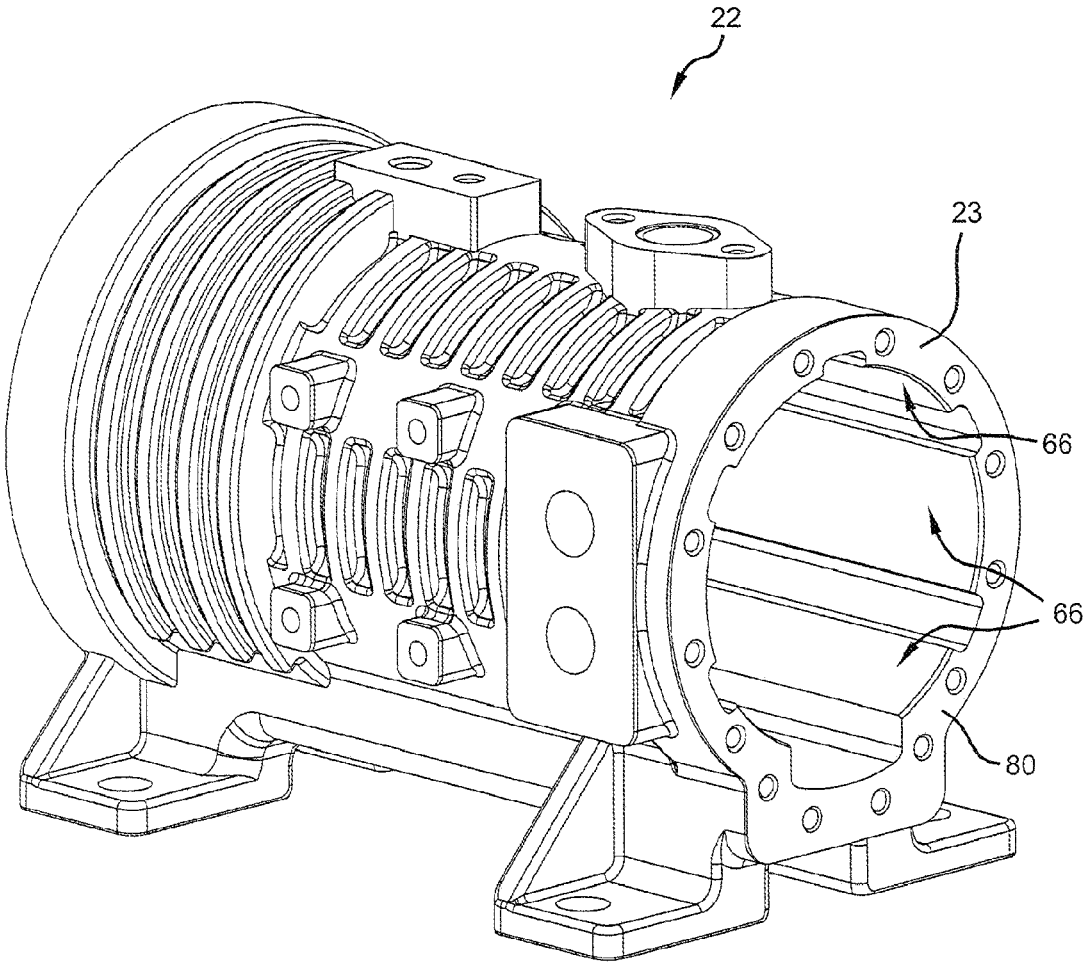
Figure 3C:
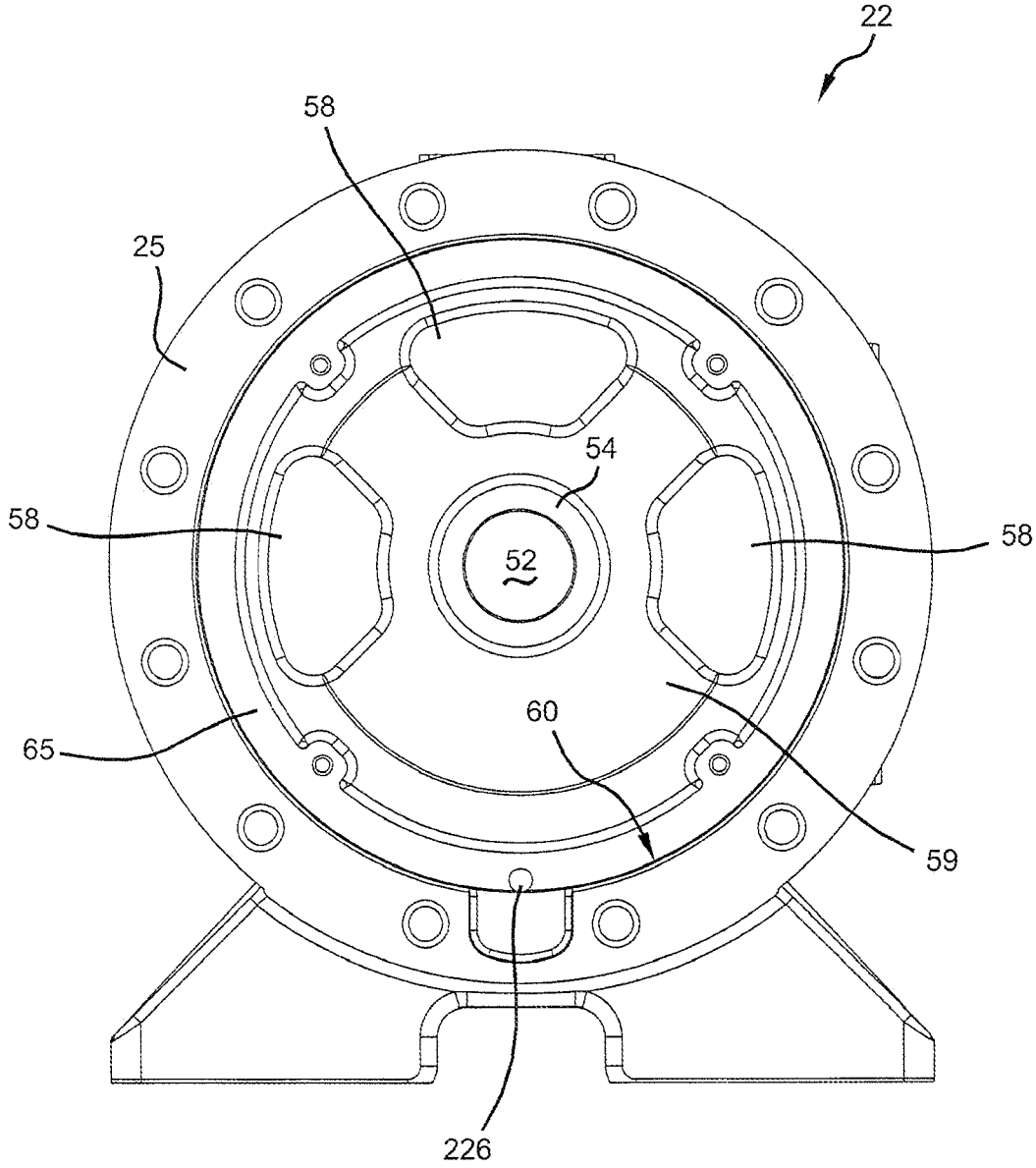
FIG. 3C is an end view of the housing of FIG. 3A.
Figure 4:
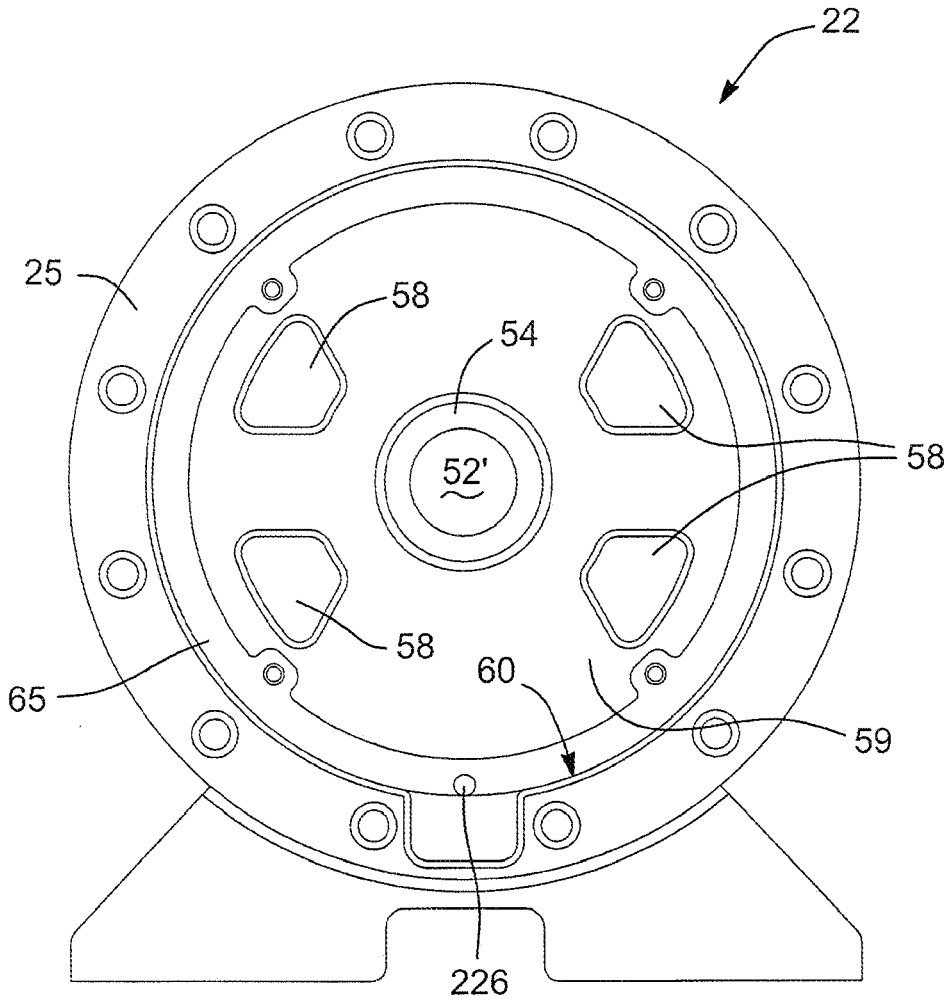
FIG. 4 is an end view of another embodiment of the housing of FIG. 3C.

Main bearing support 50 also includes a plurality of upper peripheral openings 58 that facilitate the flow of the working fluid and lubricant throughout shell 22 and compressor 20. A lower portion 59 of main bearing support 50 is solid to prevent fluid flow therethrough and defines a portion of an intermediate lubricant sump, as described below. While FIG. 3C depicts the main bearing support 50 including three openings 58, the main bearing support 50 may include four openings 58, as shown in FIG. 4. The four openings 58 shown in FIG. 4 may be arranged in a pattern that is both vertically and horizontally symmetrical (relative to the view shown in FIG. 4). Such an arrangement of the openings 58 maintains a relatively uniform stiffness across the main bearing support 50, thereby providing evenly distributed support for the bearing 54 and crankshaft 56. In still other embodiments not shown in the figures, the main bearing support 50 may include other numbers and arrangements of the openings 58. For example, three apertures 58, or any other number of apertures 58, may be arranged to provide relatively uniform support for the bearing 54 and crankshaft 56.

Shell 22 also includes a precision machined surface 60 adjacent end 25. Surface 60 is cylindrical and acts as the pilot ring for compressor 20. Surface 60 provides a precision surface for the mounting of a fixed or non-orbiting scroll 62 of a scroll assembly 64. Surface 60 also provides a precision surface for the mounting of partition 26. A precision machined shoulder 65 is adjacent surface 60 and provides a precision surface for mounting a thrust plate 112 in shell 22. Shell 22 also includes a plurality of precision machined surfaces 66 adjacent first end 23. Each surface 66 forms a part of a cylinder and collectively provide a precision surface for the precise alignment and centering of a stator 68 of a motor 70 within shell 22. Surfaces 66 also provide a precision surface for the precise alignment and centering of LS end cap 24. Ends 23, 25 are also machined surfaces for the attachment of LS end cap 24 and partition 26 and HS end cap 28 to shell 22.

Figure 2:
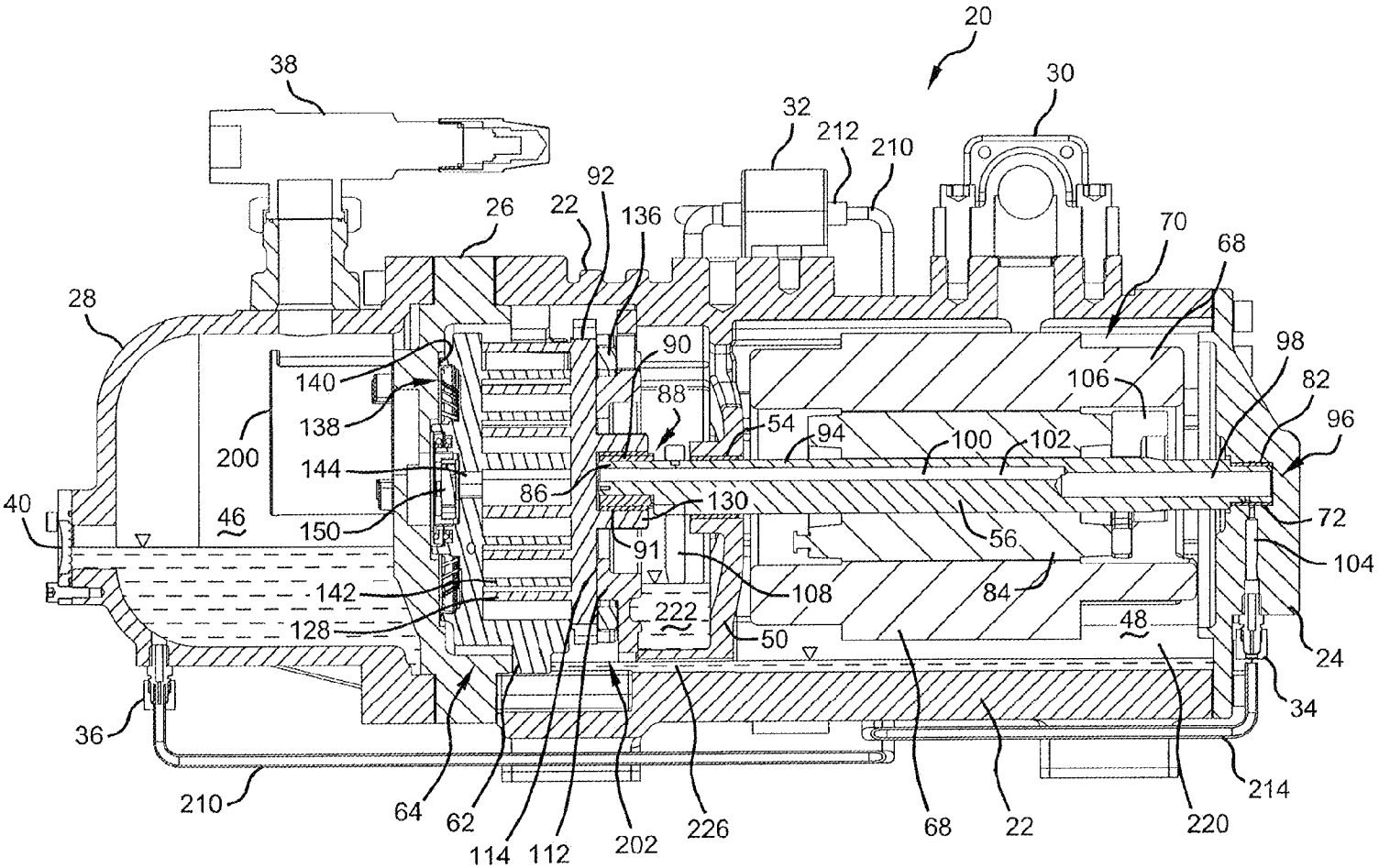
FIG. 2 is a cross-sectional view along line 2-2 of FIG. 1C.
Figure 5:
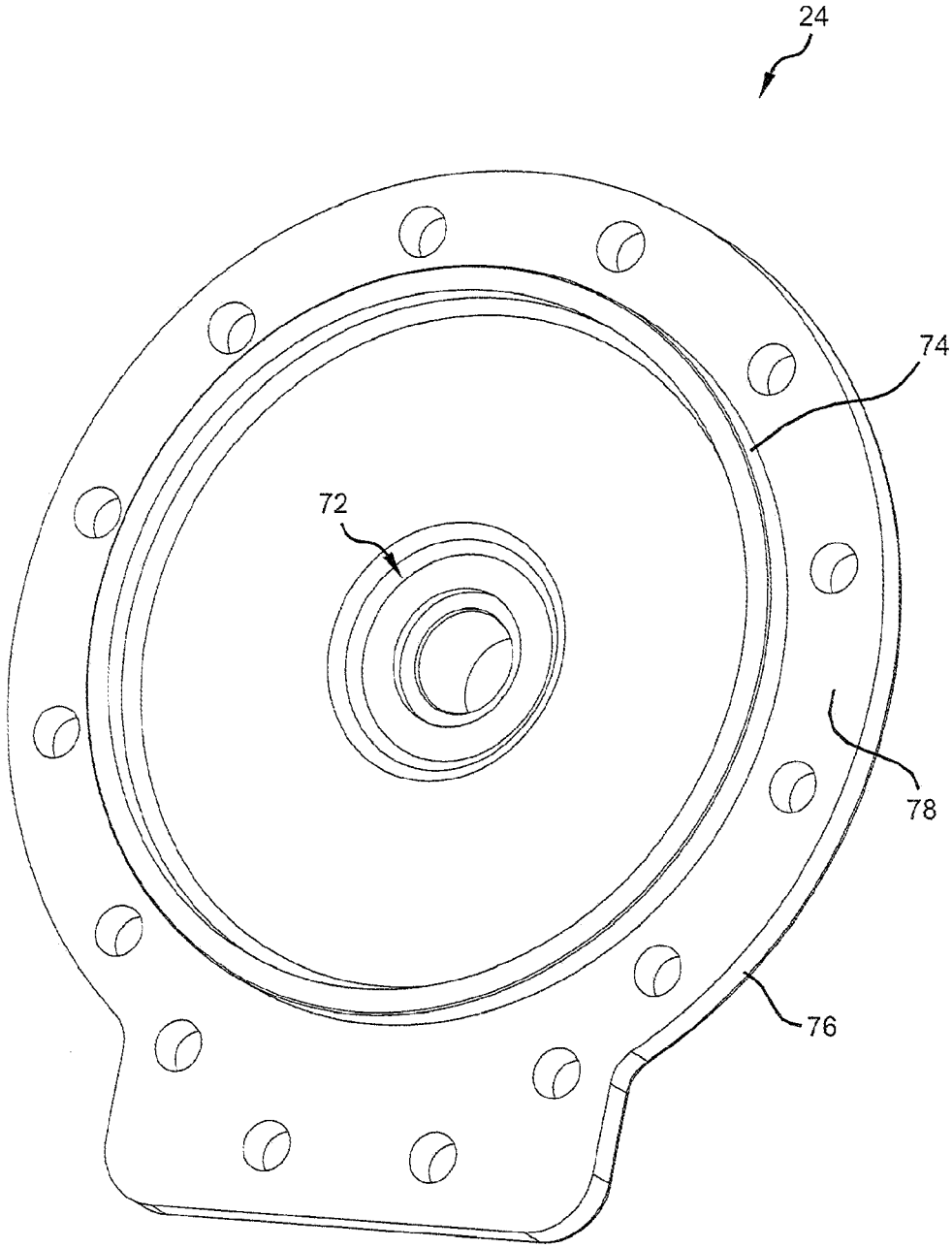
FIG. 5 is a perspective view of the low-side cover of the compressor of FIG. 1.

Referring now to FIGS. 2 and 5, LS end cap 24 includes a central recessed bore 72 and an outwardly projecting annular rim 74 circumscribing bore 72 and spaced radially inwardly from a periphery 76 of LS end cap 24. An engaging surface 78 extends between rim 74 and periphery 76. Engaging surface 78 is configured to engage against end 23 of shell 22. A gasket or other sealing means can be disposed between surface 78 and end 23 to provide a fluid-tight seal therebetween, by way of non-limiting example. Bore 72 and rim 74 are precision machined surfaces in LS end cap 24 and provide precise centering of LS end cap 24 and crankshaft 56 within compressor 20. Specifically, a bearing or bushing 82 is press fit into bore 72 and an end 96 of crankshaft 56 is disposed in bearing 82. Rim 74 engages with multiple surfaces 66 to provide a precise centering of LS end cap 24 relative to shell 22 such that bore 72 is aligned with central opening 52 and crankshaft 56 is precisely located within compressor 20.

Motor 70 includes stator 68 and a rotor 84 press fit onto crankshaft 56. Stator 68 is press fit into shell 22 with the exterior surface of stator 68 engaging with multiple surfaces 66. As such, surfaces 66 can provide a precise centering of stator 68 within shell 22. The precision machined surfaces of opening 52, surfaces 66, bore 72, and rim 74 facilitate precise alignment of crankshaft 56 and motor 70 within compressor 20 such that a precise gap exists between rotor 84 and stator 68 along with the proper alignment to the other components of compressor 20.

Referring to FIG. 2, crankshaft 56 has an eccentric crankpin 86 at one end 88 thereof. Crankpin 86 is rotatably journaled in a generally D-shaped inner bore of a drive bushing 90 disposed in a drive bearing 91 press fit into an orbiting scroll 92 of scroll assembly 64, as described in more detail below. Drive bushing 90 has a circular outer diameter. An intermediate portion 94 of crankshaft 56 is rotatably journaled in bearing 54 of opening 52 in main bearing support 50. The other end 96 of crankshaft 56 is rotatably journaled in bearing 82 in bore 72 of LS end cap 24.

Crankshaft 56 has, at end 96, a relatively large diameter, concentric bore 98, which communicates with a radially outwardly smaller diameter bore 100 extending therefrom to end 88. Bores 98, 100 form an internal lubricant passageway 102 in crankshaft 56. Lubricant is supplied to bore 98 through a lubricant passageway 104 in LS end cap 24 that communicates with inlet fitting 34.

Crankshaft 56 is rotatably driven by electric motor 70 including rotor 84 and stator 68. A first counterweight 106 is coupled to rotor 84 adjacent end 96 of crankshaft 56. A second counterweight 108 is attached to crankshaft 56 between end 88 and intermediate portion 94.

Figure 11:
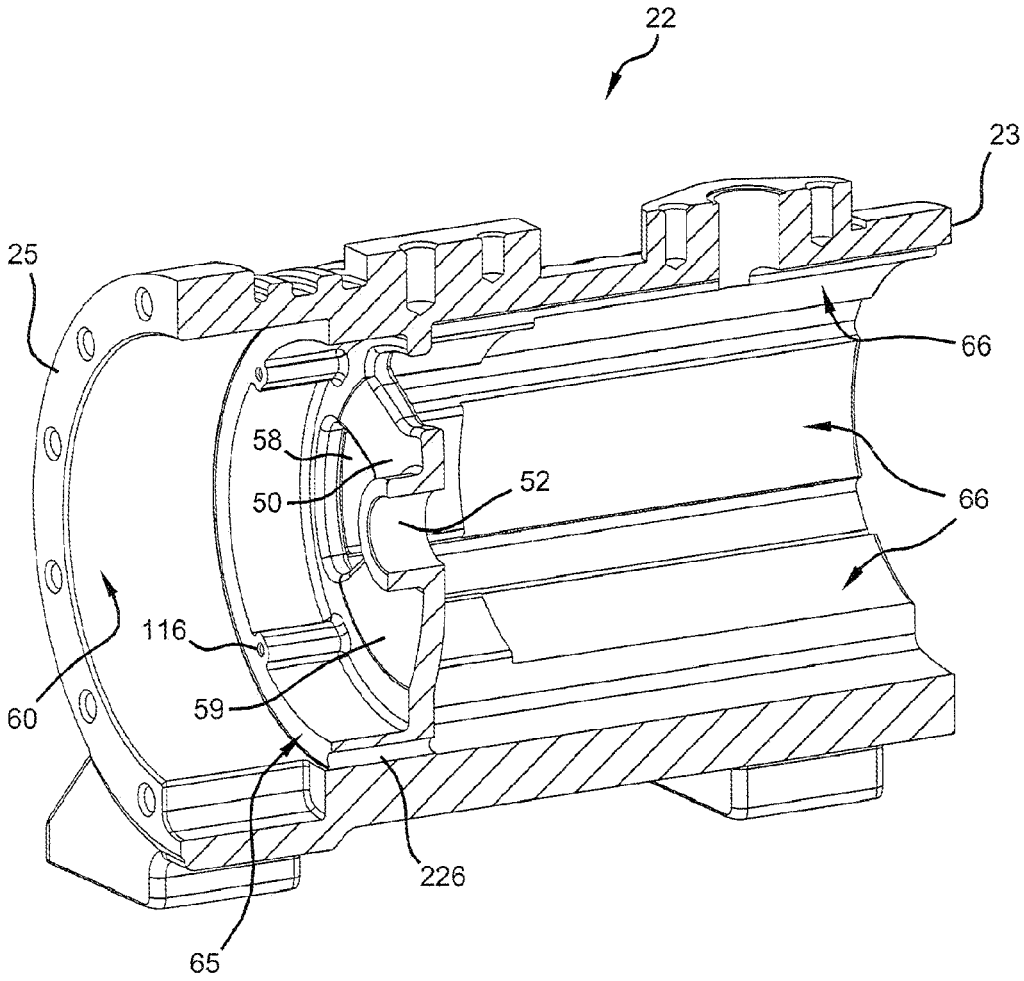
FIG. 11 is a cross-sectional view along line 11-11 of FIG. 3A.
Figure 12:
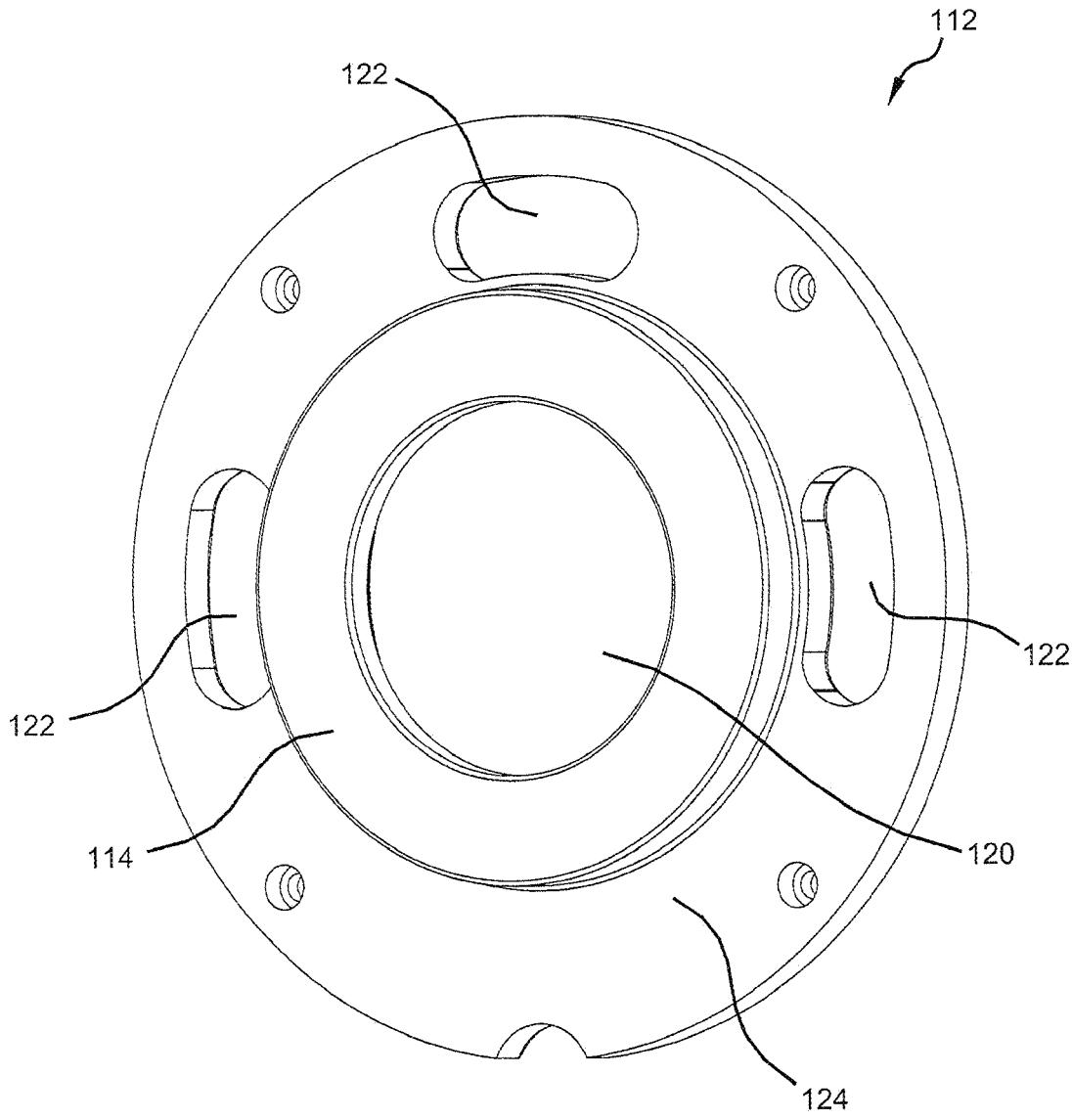
FIG. 12 is a perspective view of the thrust plate of the compressor of FIG. 1.

Referring now to FIGS. 2 and 11-12, a thrust plate 112 is disposed in compressor 20 against machined shoulder 65 between end 25 and main bearing support 50. Thrust plate 112 may be secured within shell 22 with a plurality of fasteners that engage with complementing bores 116 in shell 22, by way of non-limiting example. Thrust plate 112 can thereby be fixedly secured within shell 22 with the surface of thrust plate 112 against shoulder 65. The opposite side of thrust plate 112 includes an annular thrust-bearing surface 114 which axially supports orbiting scroll 92. Thrust plate 112 includes a central opening 120 and a plurality of upper peripheral openings 122. Openings 122 are arranged on thrust plate 112 such that thrust plate 112 has a lower solid section 124 below central opening 120. Solid section 124 defines a portion of an intermediate lubricant sump, as described below. Openings 122 allow fluids, such as lubricant and working fluid, to flow throughout compressor 20.

Figure 13:
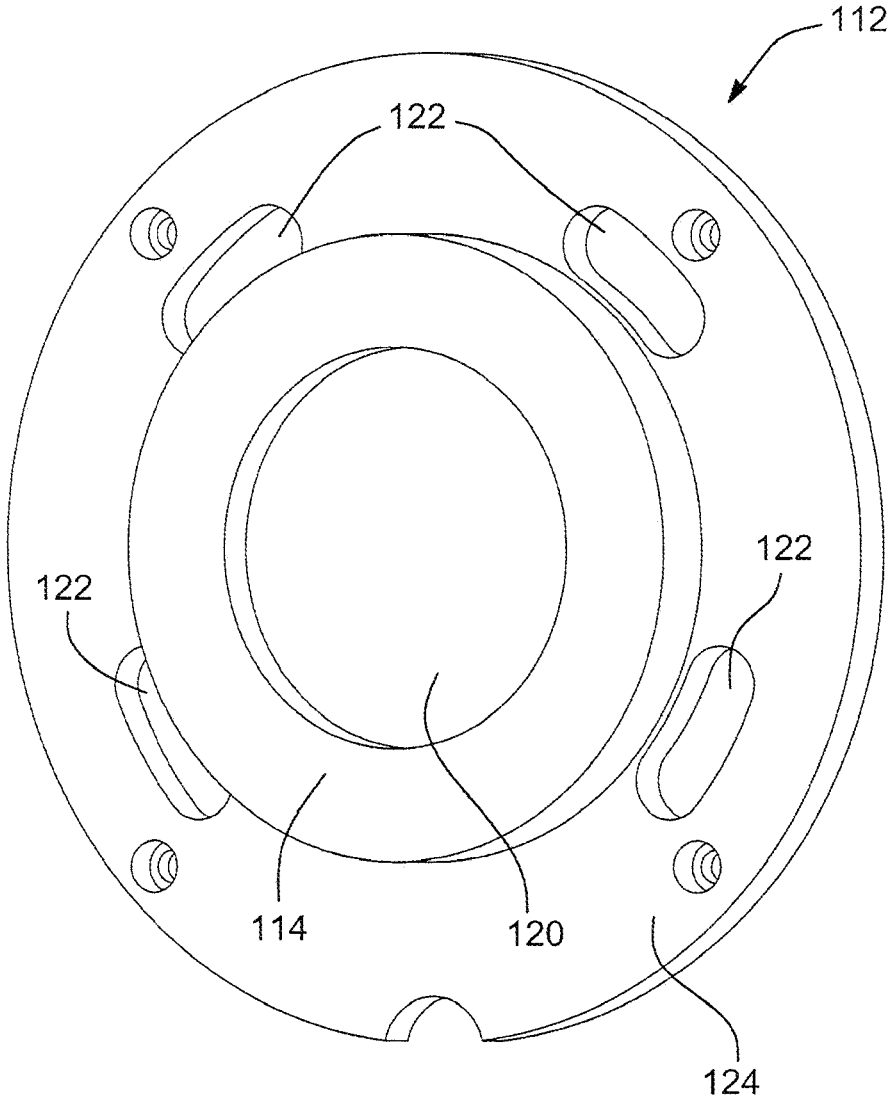
FIG. 13 is a perspective view of another embodiment of the thrust plate of the compressor.

While FIG. 12 depicts the thrust plate 112 including three openings 122, the thrust plate 112 having four openings 122, as shown in FIG. 13. The four openings 122 shown in FIG. 13 may be arranged in a pattern that may provide a relatively uniform stiffness across the thrust plate 112, thereby providing relatively evenly distributed support for the orbiting scroll 92 and reduces uneven deflection of the thrust plate 112 caused by axial forces exerted on the thrust plate 112 by the orbiting scroll 92. In still other embodiments not shown in the figures, the thrust plate 112 may include other numbers and arrangements of the openings 122. For example, three apertures 112 (or any other number of apertures 112) may be arranged to provide relatively uniform stiffness across the thrust plate 112 and evenly distributed support for the orbiting scroll 92.

Orbiting scroll 92 includes a first spiral wrap 128 on a first surface thereof. The opposite or second surface of orbiting scroll 92 engages with thrust-bearing surface 114 of thrust plate 112 and includes a cylindrical hub 130 that projects therefrom and extends into central opening 120 of thrust plate 112. Rotatably disposed within hub 130 is bushing 90 in which crankpin 86 is drivingly disposed. Crankpin 86 has a flat on one surface which drivingly engages the flat surface of the inner bore to provide a radially compliant driving arrangement, such as shown in Assignee's U.S. Pat. No. 4,877,382, the disclosure of which is hereby incorporated by reference.

An Oldham coupling 136 is disposed between orbiting scroll 92 and thrust plate 112. Oldham coupling 136 is keyed to orbiting scroll 92 and non-orbiting scroll 62 to prevent rotational movement of orbiting scroll 92. Oldham coupling 136 is preferably of the type disclosed in Assignee's U.S. Pat. No. 5,320,506, the disclosure of which is hereby incorporated by reference. A seal assembly 138 is supported by non-orbiting scroll 62 and engages a seat portion 140 of partition 26 for sealingly dividing suction chamber 48 from discharge chamber 46. Seal assembly 138 can be the same as that disclosed in Assignee's U.S. patent application Ser. No. 12/207,051, the disclosure of which is incorporated herein by reference.

Referring now to FIGS. 2 and 7-10, non-orbiting scroll 62 includes a second spiral wrap 142 positioned in meshing engagement with first spiral wrap 128 of orbiting scroll 92. Non-orbiting scroll 62 has a centrally disposed discharge passage or port 144 defined by a base-plate portion 146. Non-orbiting scroll 62 also includes an annular hub portion 148, which surrounds discharge passage 144. A unitary shutdown device or discharge valve 150 can be provided in discharge passage 144. Discharge valve 150 is shown as a normally closed valve. During operation of compressor 20, the valve may be in an open position or a closed position depending on pressure differentials between discharge passage 144 and discharge chamber 46 as well as the design of discharge valve 150. When operation of compressor 20 ceases, discharge valve 150 closes.

Non-orbiting scroll 62 includes a machined peripheral surface 154 that is dimensioned for a clearance fit with surface 60 of shell 22. As a result of the precision machining of surface 60 and peripheral surface 154, non-orbiting scroll 62 is precisely centered within compressor 20. Non-orbiting scroll 62 includes an opening 156 adjacent to peripheral surface 154 and extends through base plate portion 146. Opening 156 is configured to receive an anti-rotation pin 157 which extends from partition 26 to prevent rotation of non-orbiting scroll 62 within compressor 20. A bleed opening 158 extends through base-plate portion 146 and allows compressed fluid between first and second wraps 128, 142 to bleed into an intermediate cavity 160 between non-orbiting scroll 62 and partition 26. The bleed opening 158 allows pressurized fluid to enter cavity 160 and bias non-orbiting scroll 62 toward orbiting scroll 92.

Non-orbiting scroll 62 includes a first radially extending passageway 162 that can receive a temperature probe 164 measuring non-orbiting scroll 62 temperature near the discharge pressure region. By way of non-limiting example, temperature probe 164 could be a positive temperature coefficient thermistor, a negative temperature coefficient thermistor or a thermocouple. Non-orbiting scroll 62 can include a second radial passage 166 that communicates with two branches 168, 170. Passage 166 communicates with inlet fitting 42 that extends through partition 26. At the end portions of each branch 168, 170 are a pair of axially extending openings 172 that extends into the compression cavities formed between first and second wraps 128, 142. Passage 166, branches 168, 170, and openings 172 allow a fluid to be injected into the compression cavities between first and second wraps 128, 142 at intermediate pressure locations.

Figure 6:
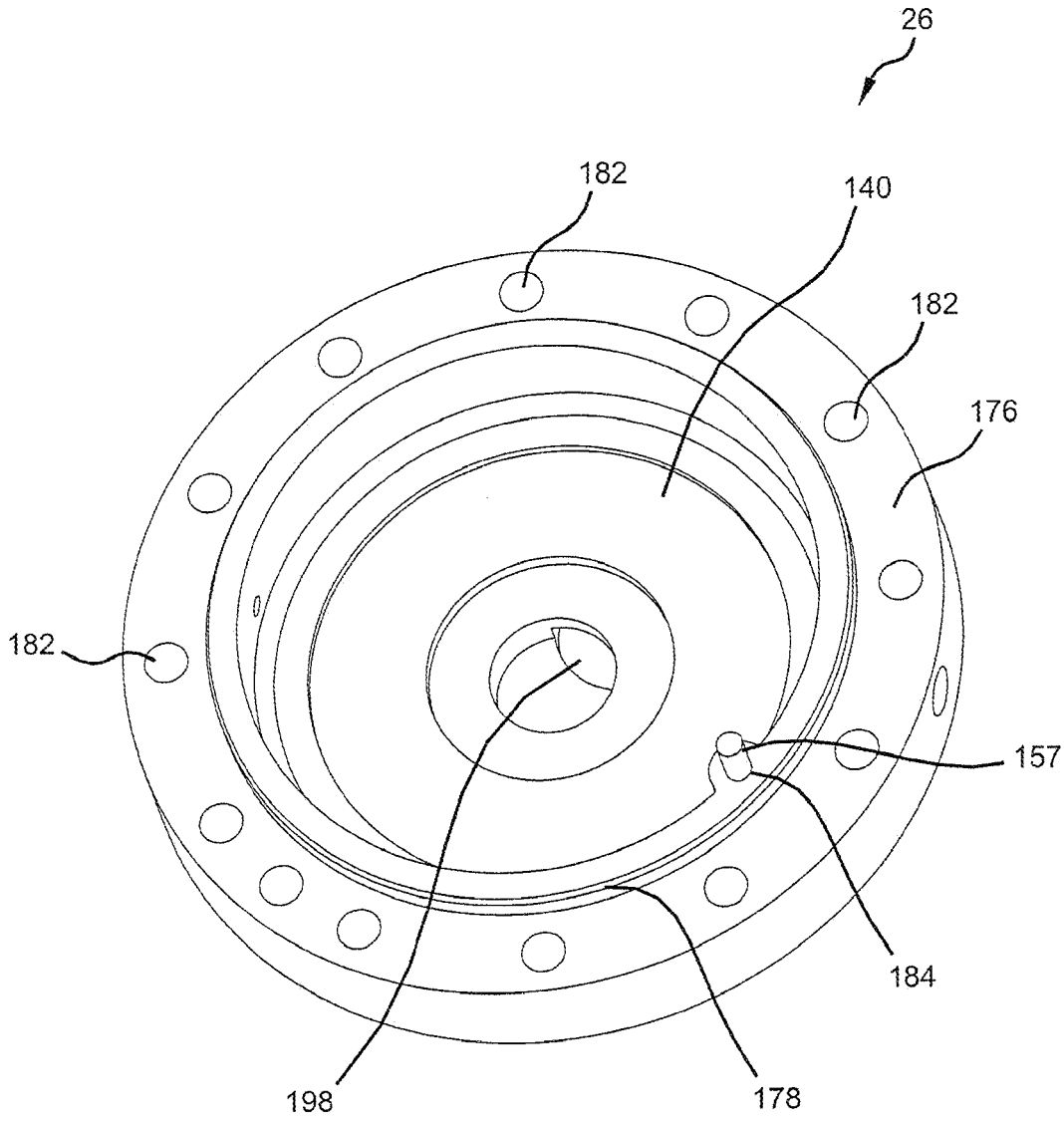
FIG. 6 is a perspective view of the partition of the compressor of FIG. 1.
Figure 7:
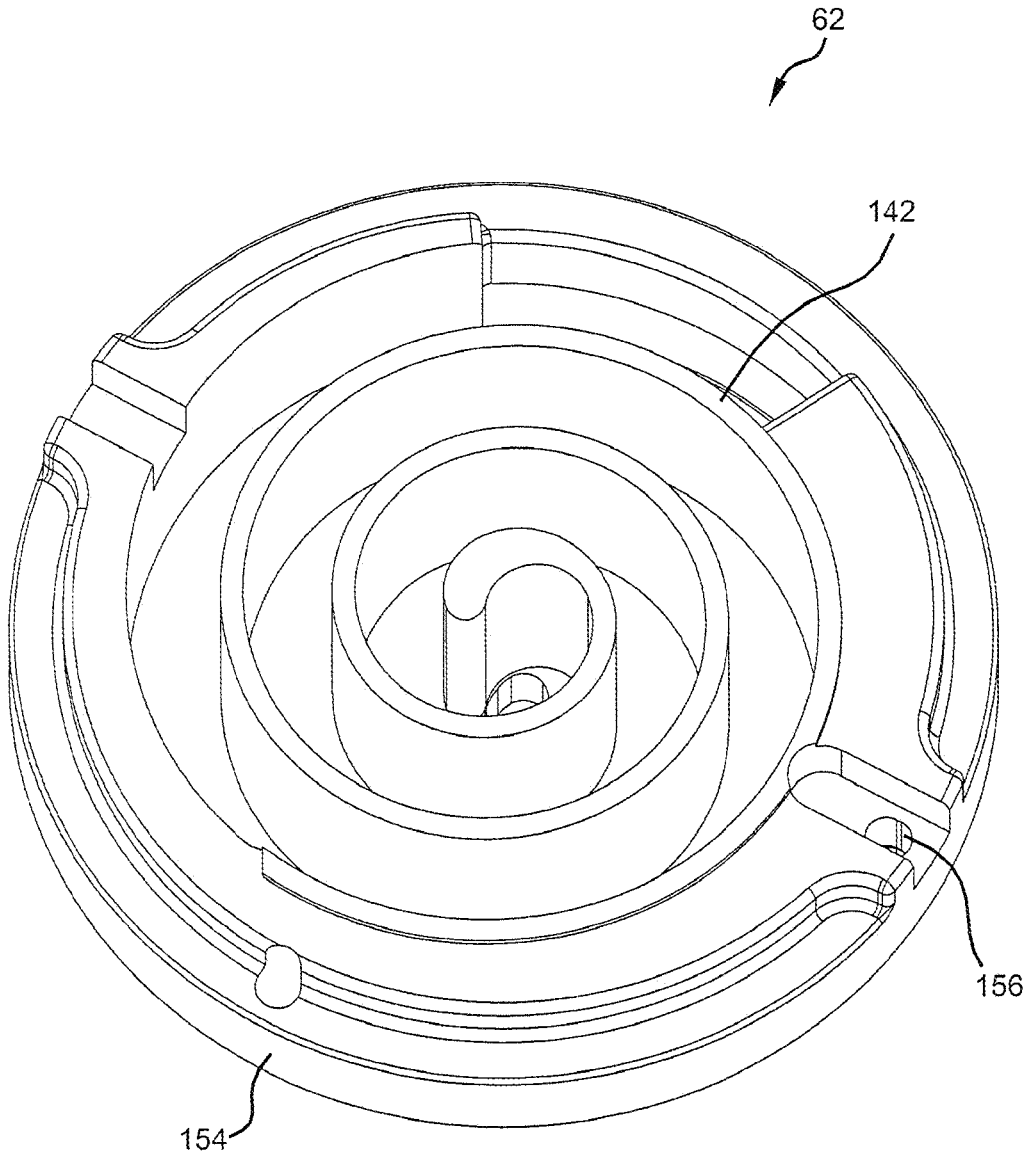
FIGS. 7 and 8 are perspective views of the non-orbiting scroll of the compressor of FIG. 1.
Figure 8:
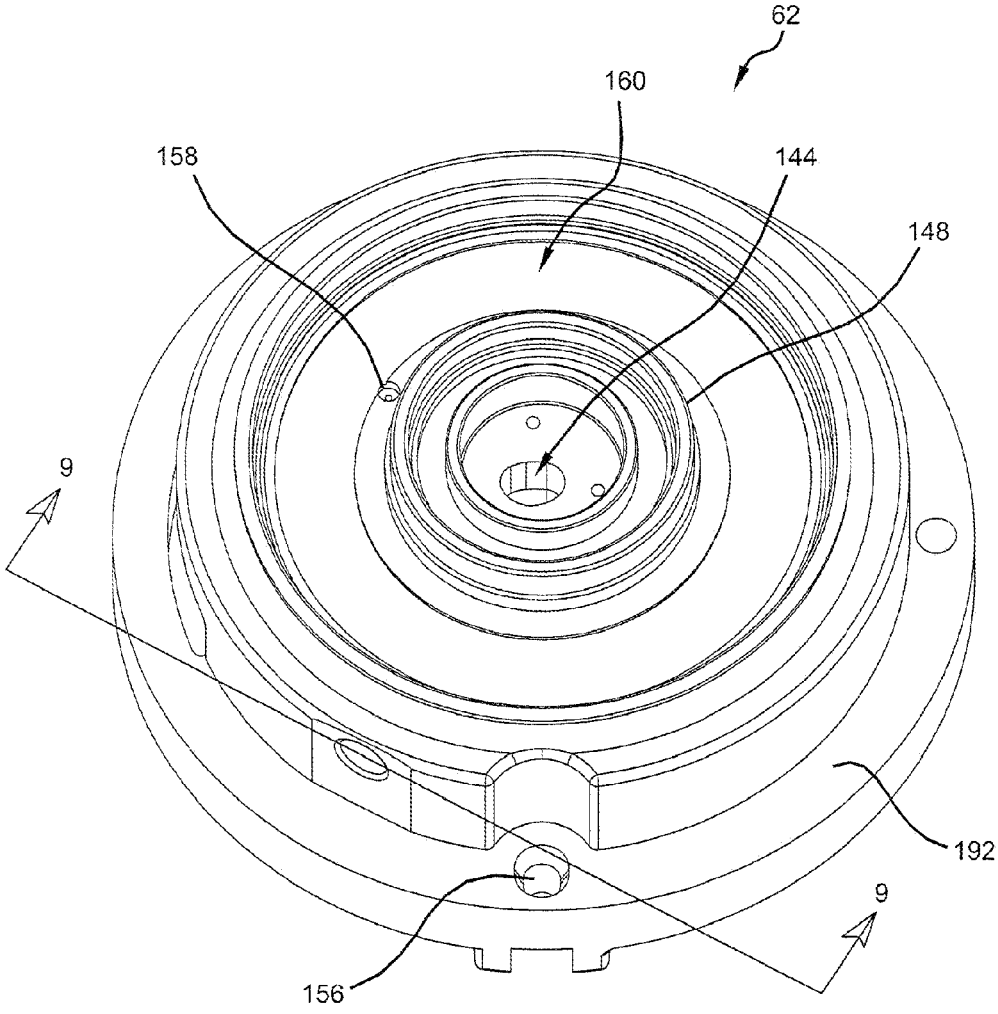
Figure 9:
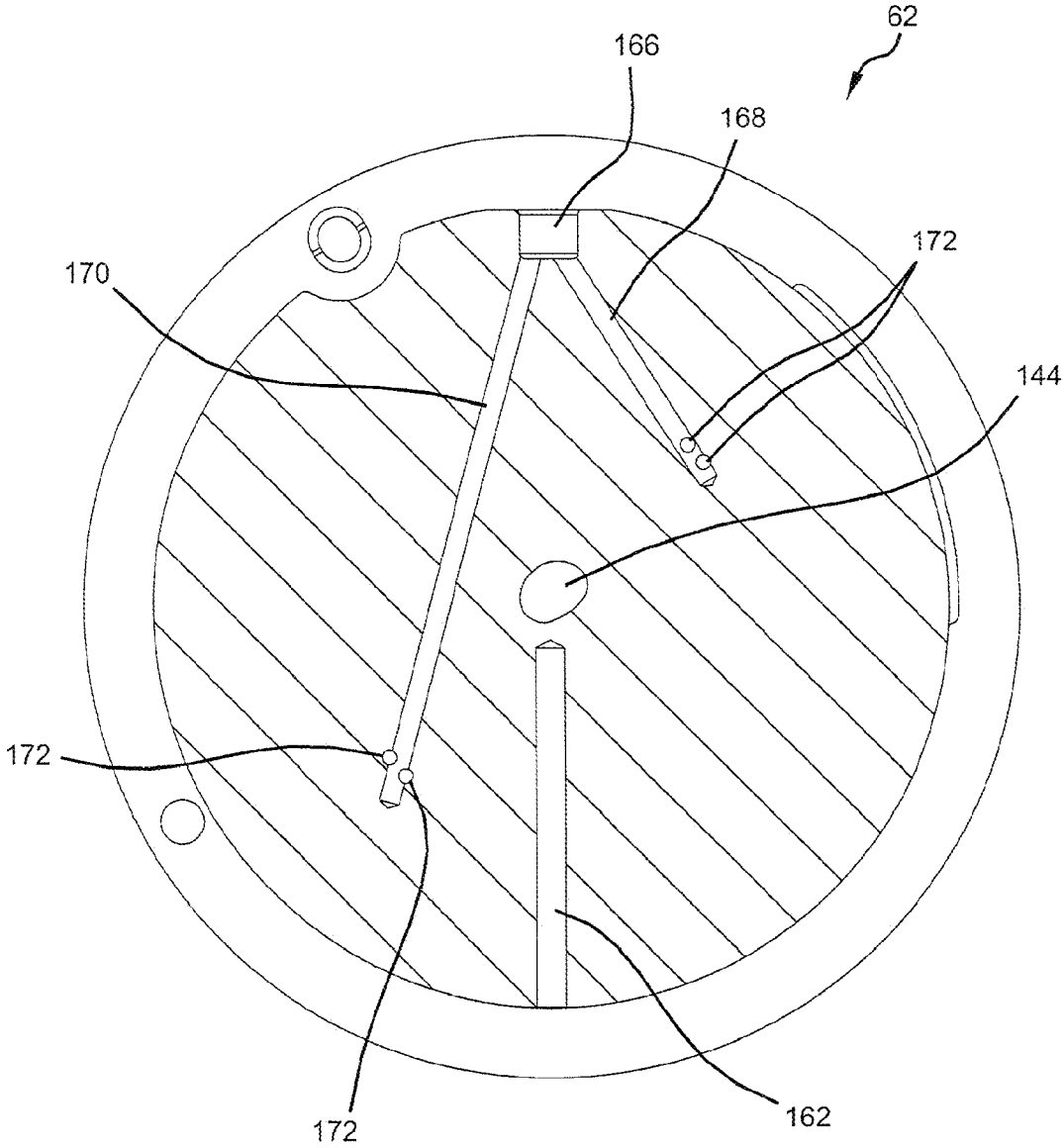
FIG. 9 is a cross-section view along line 9-9 of FIG. 8.
Figure 10:
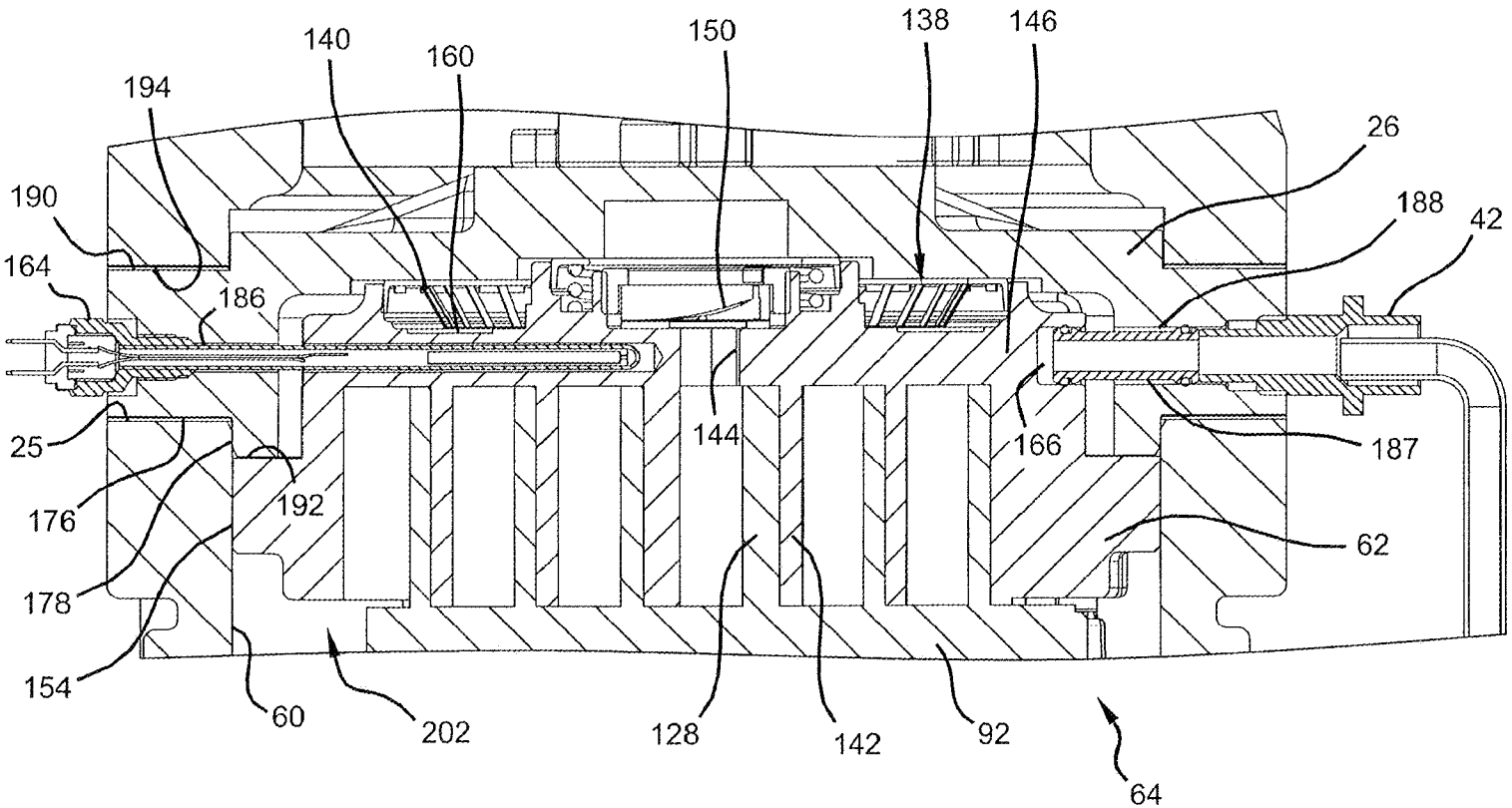
FIG. 10 is an enlarged fragmented cross-sectional view of a portion of the compressor of FIG. 1 showing features of the non-orbiting scroll and partition.

Referring now to FIGS. 2, 6, and 10, partition 26 includes a machined engaging surface 176 that extends adjacent the periphery and a machined-raised annular rim 178 extending from engaging surface 176. Engaging surface 176 engages with end 25 of shell 22. A gasket or other sealing means can be disposed between surface 176 and end 25 to provide a fluid-tight seal therebetween, by way of non-limiting example. Rim 178 engages with precision machined surface 60 of shell 22 to provide precise centering of partition 26 relative to shell 22. Rim 178 is dimensioned to form a clearance fit against surface 60 of shell 22. Rim 178 may axially engage with an engaging surface 192 on non-orbiting scroll 62 adjacent its periphery. Engagement of rim 178 with engaging surface 192 limits the axial positioning of non-orbiting scroll 62 within shell 22. Partition 26 includes a central seat portion 140 that faces non-orbiting scroll 62 and forms a portion of the intermediate cavity 160 that allows pressurized fluid to bias non-orbiting scroll 62 toward orbiting scroll 92. Partition 26 includes a plurality of openings 182 adjacent the periphery for fastening to shell 22 in conjunction with HS end cap 28 with fasteners. Partition 26 includes an opening 184 in rim 178 that is configured to receive anti-rotation pin 157 that engages with opening 156 in non-orbiting scroll 62 to prevent rotation of non-orbiting scroll 62 within compressor 20. A pair of radial passages 186, 188 is provided in the periphery of partition 26 to receive temperature probe 164 and inlet fitting 42 coupled to an internal fluid injection tube 187, respectively. Partition 26 includes a second engaging surface 190 on an opposite side from engaging surface 176. Engaging surface 190 is machined and is configured to engage with a complementary machined engaging surface 194 of HS end cap 28. A gasket or other sealing means can be disposed between engaging surfaces 190, 194 to provide a fluid-tight seal therebetween, by way of non-limiting example.

Partition 26 includes a central opening 198 that communicates with discharge passage 144 and discharge valve 150 on one side thereof and with a fluid filter/separator 200 on an opposite side thereof. Partition 26 separates the suction chamber 48 from discharge chamber 46.

During operation of compressor 20, working fluid and lubricant flow from suction chamber 48 through lower scroll intake 202 and into the chambers formed between first and second wraps 128, 142 and are subsequently discharged through discharge passage 144, discharge valve 150 and through opening 198 in partition 26 and into separator 200 in discharge chamber 46. Within separator 200, the lubricant is separated from the working fluid and the lubricant falls, via gravity, to the lower portion of discharge chamber 46 while the working fluid is discharged from discharge chamber 46 through discharge fitting 38 in HS end cap 28.

Figure 1B:
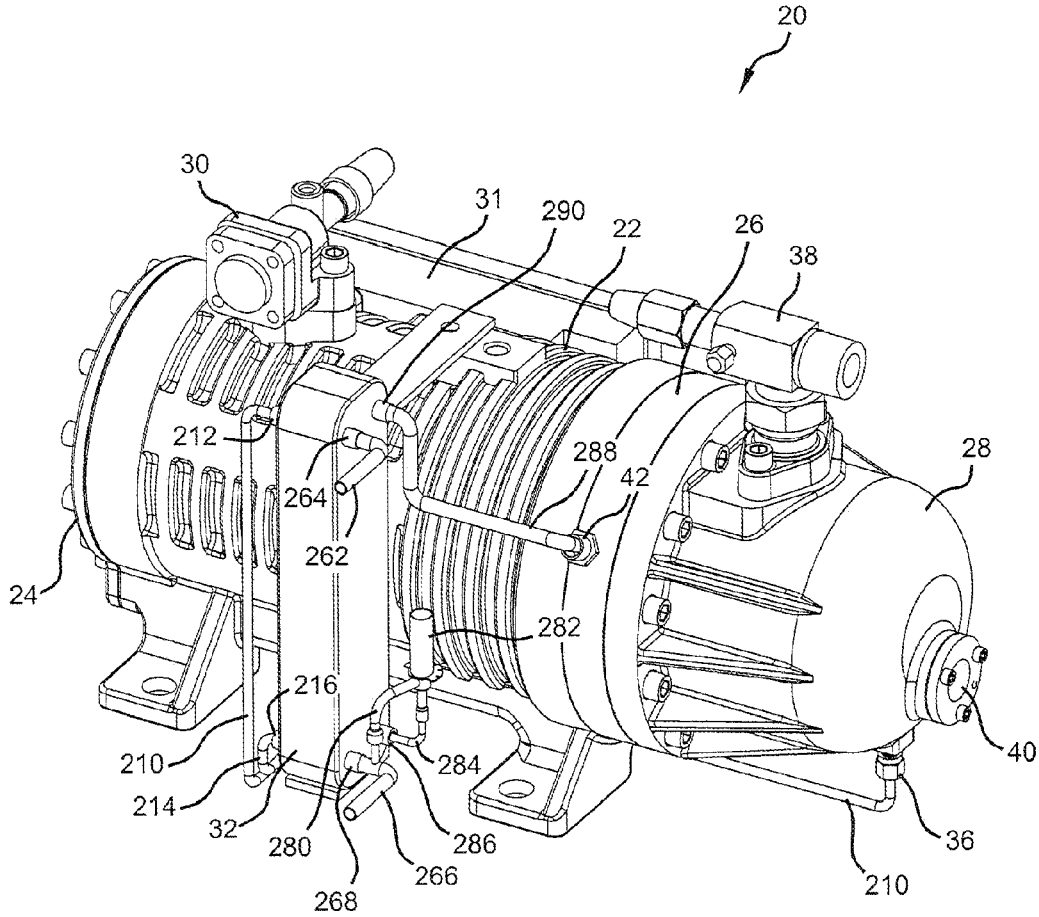
Figure 1C:
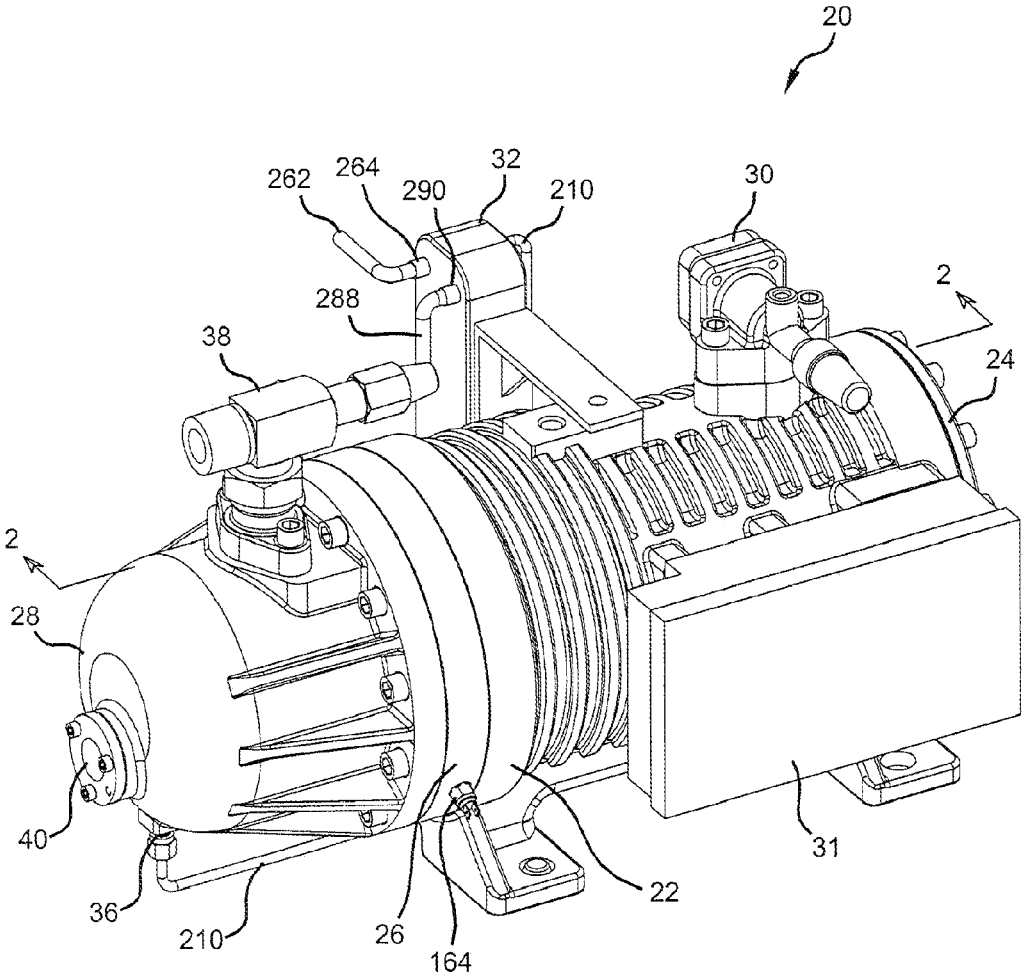

Referring to FIGS. 1-2, outlet fitting 36 in HS end cap 28 communicates with discharge chamber 46 and the lubricant therein. A lubricant line 210 extends from outlet fitting 36 and into a top portion of heat exchanger 32 through a fitting 212. A lubricant return line 214 extends from a fitting 216 on a lower portion of heat exchanger 32 to inlet fitting 34 on LS end cap 24. Discharge chamber 46 is at a discharge pressure while suction chamber 48 is at a suction pressure, typically less than the discharge pressure. The pressure differential causes the lubricant to flow from discharge chamber 46 to suction chamber 48 through heat exchanger 32. Specifically, the lubricant flows through lubricant line 210, through heat exchanger 32, through return line 214, and passageway 104 in LS end cap 24. From passageway 104, the lubricant flows into bearing 82 to lubricate bearing 82 along with end 96 of crankshaft 56. The lubricant also flows into the large bore 98 and then through small bore 100 as it travels to end 88 of crankshaft 56. When crankshaft 56 is rotating, the centrifugal force causes the lubricant to flow from large bore 98 to small bore 100 and onto end 88. The lubricant exits end 88 and flows into and around drive bushing 90 in the hub 130 of orbiting scroll 92.

The lubricant flowing out of end 88 falls by gravity into an intermediate sump 222. Intermediate sump 222 is defined by solid section 124 of thrust plate 112 and solid lower portion 59 of main bearing support 50. Lubricant may accumulate in intermediate sump 222 during operation of compressor 20. During rotation of crankshaft 56, counterweight 108 travels through the lubricant in intermediate sump 222 and splashes or sloshes the lubricant therein throughout the space between main bearing support 50 and thrust plate 112 such that Oldham coupling 136 and the interface between thrust plate 112 and orbiting scroll 92 receive lubrication. The lubricant flow provides lubrication and a cooling effect.

Lubricant within bore 72 of LS end cap 24 can flow downward via gravity and some lubricant may accumulate in a motor area 220 around the lower portion of stator 68 and rotor 84. Motor area 220 is defined by the opposite side of solid lower portion 59 of main bearing support 50, shell 22, and LS end cap 24. The lubricant exiting bore 72 drops to the bottom of shell 22 and flows to the scroll side of shell 22 through a passageway 226, as described below.

Passageway 226 extends between motor area 220 and the far side of thrust plate 112 adjacent lower scroll intake 202. Passageway 226 can be machined through main bearing support 50 of shell 22. The separation of passageway 226 from intermediate sump 222 advantageously allows some lubricant to collect or pool in intermediate sump 222 for lubrication of the components therein and adjacent or approximate thereto via the rotation of crankshaft 56 and of counterweight 108. The engagement of thrust plate 112 with shoulder 65 of shell 22 may provide a semi-fluid-tight engagement wherein lubricant in intermediate sump 222 can pool while still allowing some lubricant to flow out as it is being replaced by incoming lubricant exiting end 88 of crankshaft 56, thereby providing continuous flow into and out of intermediate sump 222. The solid section 124 and solid section 59 thereby form an intermediate sump 222 that can pool lubricant therein during operation of compressor 20. These features may be cast into thrust plate 112 and shell 22. As shown in FIG. 2, the nominal operational lubricant level in intermediate sump 222 is significantly higher than in motor area 220. The nominal operational lubricant level in discharge chamber 46 is also shown.

In operation, motor 70 is energized causing crankshaft 56 to begin rotating about its axis, thereby causing orbiting scroll 92 to move relative to non-orbiting scroll 62. This rotation pulls working fluid into suction chamber 48. Within suction chamber 48, working fluid and lubricant mix together and are pulled into lower scroll intake 202 and between first and second wraps 128, 142 of orbiting and non-orbiting scrolls 92, 62. The working fluid and lubricant are compressed therein and discharged through discharge passage 144 and discharge valve 150 to discharge pressure. The discharged working fluid and lubricant flow into lubricant separator 200 wherein the working fluid passes therethrough and the lubricant therein is entrapped and flows, via gravity, into the bottom portion of discharge chamber 46. The working fluid flows out of discharge chamber 46 through discharge fitting 38 and into the system within which compressor 20 is utilized. If the system is a closed system, the working fluid, after passing through the system, flows back into suction chamber 48 of compressor 20 via inlet fitting 30.

Figure 14:
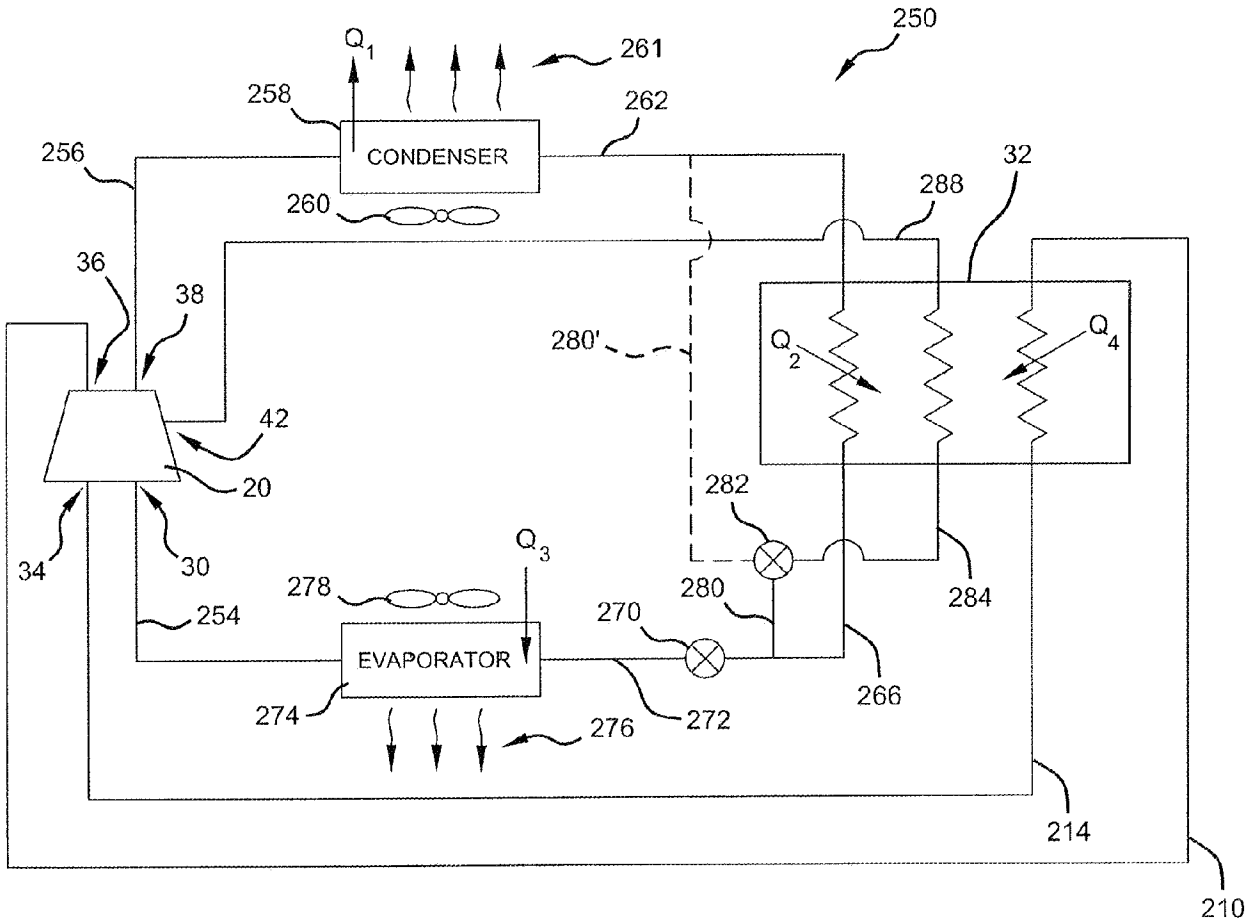
FIG. 14 is a schematic view of the cooling system utilized with the compressor of FIG. 1 within a refrigeration system according to the present teachings.

Referring now to FIGS. 1 and 14, cooling of the lubricant when compressor 20 is utilized in conjunction with an exemplary refrigeration system 250 is shown. Refrigeration system 250 includes compressor 20 that compresses the working fluid (e.g., refrigerant) flowing therethrough from a suction pressure to a discharge pressure greater than the suction pressure. Inlet fitting 30 is in fluid communication with a suction line 254 and with suction chamber 48. Discharge fitting 38 is in fluid communication with a discharge line 256 that receives compressed working fluid from discharge chamber 46 of compressor 20. Inlet fitting 42 forms an intermediate-pressure port that communicates with the compression cavities of scroll assembly 64 in compressor 20 at a location that corresponds to an intermediate pressure between the discharge pressure and the suction pressure. Inlet fitting 42 can thereby supplies a fluid to the compression cavities of compressor 20 at an intermediate-pressure location.

Discharge working fluid flowing through discharge line 256 flows into a condenser 258 wherein heat $Q_1$ is removed from the working fluid flowing therethrough. Heat $Q_1$ can be discharged to another fluid flowing across condenser 258. By way of non-limiting example, heat $Q_1$ can be transferred to an airflow 261 flowing across condenser 258 induced by a fan 260. Working fluid flowing through condenser 258 can be condensed from a high-temperature, high-pressure vapor-phase working fluid into a reduced-temperature, high-pressure condensed liquid working fluid.

The condensed working fluid flows from condenser 258 into heat exchanger 32 via a condensed working fluid line 262. The condensed working fluid can enter a top portion of heat exchanger 32 through a fitting 264. The working fluid exits heat exchanger 32 through another line 266. Line 266 can be coupled to a lower portion of heat exchanger 32 and communicate therewith via a fitting 268. Within heat exchanger 32, heat $Q_2$ is removed from the condensed working fluid flowing therethrough, as described below. As a result, the condensed working fluid is sub-cooled and exits heat exchanger 32 at a lower temperature then when entering heat exchanger 32.

The sub-cooled condensed working fluid in line 266 flows through a main throttle or expansion device 270. The working fluid flowing through expansion device 270 expands and a further reduction in temperature occurs along with a reduction in pressure. Expansion device 270 can be dynamically controlled to compensate for a varying load placed on refrigeration system 250. Alternatively, expansion device 270 can be static.

The expanded working fluid downstream of expansion device 270 flows through line 272 into an evaporator 274. Within evaporator 274, the working fluid absorbs heat $Q_3$ and may transform from a low-temperature, low-pressure liquid working fluid into an increased-temperature, low-pressure vapor working fluid. The heat $Q_3$ absorbed by the working fluid can be extracted from an airflow 276 that is induced to flow across evaporator 274 by a fan 278, by way of non-limiting example.

Suction line 254 is coupled to evaporator 274 such that working fluid exiting evaporator 274 flows through suction line 254 and back into suction chamber 48 of compressor 20, thereby forming a closed-system.

The lubricant from compressor 20 can also flow through heat exchanger 32, as described above with reference to compressor 20. Specifically, lubricant can flow, via the pressure difference between discharge chamber 46 and suction chamber 48, from discharge chamber 46, through heat exchanger 32, and back into suction chamber 48. Within heat exchanger 32, heat $Q_4$ can be removed from the lubricant flowing therethrough. As a result, the temperature of the lubricant exiting heat exchanger 32 is less than the temperature of the lubricant entering heat exchanger 32.

Compressor 20 and refrigeration system 250 utilize expanded condensed working fluid to absorb heat $Q_2$ and $Q_4$ in heat exchanger 32. Specifically, an economizer circuit can be used to sub-cool the condensed working fluid in heat exchanger 32. Sub-cooling the condensed working fluid prior to the working fluid flowing through expansion device 270 can increase the capacity of the working fluid to absorb heat $Q_3$ in evaporator 274 and thereby increase the cooling capacity of refrigeration system 250.

To provide the sub-cooling, a portion of the working fluid flowing through line 266 downstream of heat exchanger 32 may be routed through an economizer line 280, expanded in an economizer expansion device 282 (thereby reducing the temperature and pressure), and directed into heat exchanger 32 through line 284. Specifically, the economizing working fluid can be routed into a lower portion of heat exchanger 32 through a fitting 286. The expanded economizing working fluid in line 284 may be in a liquid state, a vapor state, or in a two-phase liquid and vapor state. The economizing working fluid can flow upwardly through heat exchanger 32 and exit into an injection line 288 which is connected to inlet fitting 42 of partition 26. Specifically, the economizing working fluid can exit an upper portion of heat exchanger 32 through a fitting 290 coupled to injection line 288.

Within heat exchanger 32, the economizing working fluid absorbs heat $Q_2$ from the condensed working fluid entering heat exchanger 32 through line 262 such that the temperature of the condensed working fluid is reduced (i.e., sub-cooled). The economizing working fluid exiting heat exchanger 32 through injection line 288 is injected into an intermediate-pressure location of scroll assembly 64 through inlet fitting 42 and radial passage 166, branches 168, 170, and openings 172 in non-orbiting scroll 62.

Compressor 20 and refrigeration system 250 advantageously utilize the economizer circuit to cool the lubricant flowing through compressor 20. Specifically, within heat exchanger 32, heat $Q_4$ is transferred from the lubricant into the economizing working fluid. As a result, the temperature of the lubricant exiting heat exchanger 32, via line 214, is reduced. Heat exchanger 32 thereby functions as a dual-system heat exchanger.

Expansion device 282 may be a dynamic device or a static device, as desired, to provide a desired economizer effect and cooling of the lubricant. Expansion device 282 can maintain the pressure in injection line 288 above the pressure at the intermediate-pressure location of the compression cavities that communicate with inlet fitting 42. The working fluid injected into the intermediate-pressure locations may be in a vapor state, a liquid state, or a two-phase, liquid-vapor state. The injection of the economizing working fluid into an intermediate-pressure location of the scroll assembly 64 may advantageously cool the scrolls and reduce the discharge temperature.

The use of heat exchanger 32 to extract both heat flows $Q_2$ and $Q_4$ can provide a lower complexity and/or less expensive refrigeration system wherein a single heat exchanger can provide both the sub-cooling of the condensed working fluid and the cooling of the lubricant. Additionally, the use of the economizing working fluid to cool the lubricant eliminates the need for a separate or different cooling system for the lubricant along with the use of possibly a different medium to cool the lubricant, such as chilled water. Moreover, the integration of these features into a single heat exchanger 32 allows the heat exchanger to be easily integrated onto compressor 20 such that a more compact design can be achieved, along with reducing the system footprint.

Optionally, the economizer circuit can utilize condensed refrigerant downstream of condenser 258 and upstream of heat exchanger 32. Specifically, as shown in phantom in FIG. 14, economizer line 280' can extend from line 262 to expansion device 282. When this is the case, economizer line 280 is not utilized. As a result, a portion of the condensed working fluid flowing through line 262 is routed to expansion device 282 through economizer line 280' and expanded thereacross to form the economizing working fluid flow through heat exchanger 32. The remaining operation of refrigeration system 250 is the same as that discussed above.

Figure 15:
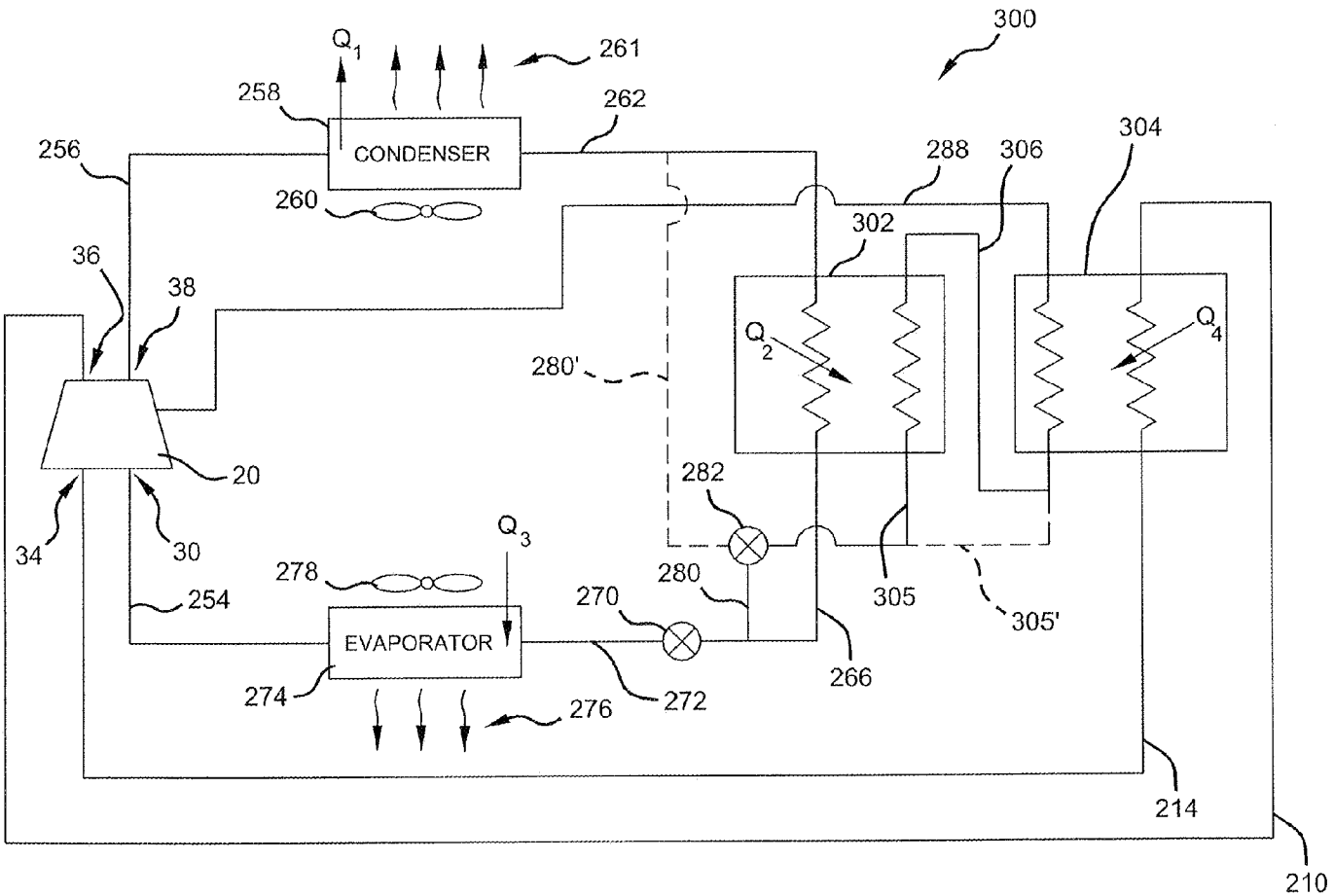
FIG. 15 is a schematic view of another cooling system for the lubricant utilized in a compressor and within a refrigeration system according to the present teachings.

Referring now to FIG. 15, an alternate configuration for cooling the lubricant is schematically illustrated in a refrigeration system 300. Refrigeration system 300 is similar to refrigeration system 250, discussed above, and the same reference numerals are utilized to indicate the same or similar components, lines, features, etc. As such, only the main differences between refrigeration system 300 and refrigeration system 250 are discussed in detail.

A difference in refrigeration system 300 is that a single dual-system heat exchanger 32 is not utilized. Rather, in refrigeration system 300, two separate heat exchangers 302, 304 are utilized. In refrigeration system 300, heat exchanger 302 functions as an economizer heat exchanger to sub-cool the condensed working fluid flowing therethrough while heat exchanger 304 functions to reduce the temperature of the lubricant flowing therethrough. Specifically, a line 305 extends from expansion device 282 to heat exchanger 302 and directs the expanded working fluid into heat exchanger 302. Within heat exchanger 302, heat $Q_2$ is absorbed by the expanded working fluid from the condensed working fluid entering in heat exchanger 302 through line 262. As a result, the condensed working fluid is sub-cooled in heat exchanger 302 by the expanded working fluid.

The expanded working fluid exits heat exchanger 302 through a line 306 and flows into heat exchanger 304. Heat exchanger 304 operates as a lubricant heat exchanger. Lubricant line 210 extends from compressor 20 into heat exchanger 304 and lubricant return line 214 extends from heat exchanger 304 back to compressor 20. Within heat exchanger 304, heat $Q_4$ is removed from the lubricant flowing therethrough and transferred into the expanded working fluid flowing through heat exchanger 304. As a result, the temperature of the lubricant flowing through heat exchanger 304 is reduced.

The expanded working fluid exits heat exchanger 304 and is injected into an intermediate-pressure location within scroll assembly 64 in compressor 20 through injection line 288, as discussed above. The expanded working fluid flowing through heat exchangers 302, 304 can enter therein and exit therefrom in a liquid state, a vapor state, or a two-phase, liquid-vapor state.

Optionally, in refrigeration system 300, the sub-cooling of the condensed working fluid can be eliminated. In such an arrangement, heat exchanger 302 and lines 266 and 306 would not be present. Rather, condensed working fluid is extracted from line 262 prior to flowing through expansion device 270, expanded through expansion device 282, and provided to heat exchanger 304 through expanded working fluid line 305' (shown in phantom). In this configuration, the working fluid expanded by expansion device 282 is utilized to absorb a single heat flow $Q_4$ from the lubricant flowing through heat exchanger 304. As a result, the temperature of lubricant from heat exchanger 304 is reduced. The expanded working fluid exiting heat exchanger 304 is injected into an intermediate-pressure location of compressor 20 through injection line 288, as discussed above.

Thus, in refrigeration system 300, condensed working fluid can be expanded and utilized to sub-cool the condensed working fluid and/or cool the lubricant that flows through compressor 20. The use of the expanded working fluid can advantageously reduce system complexity and cost by avoiding the necessity of a different external cooling media for cooling the lubricant. Additionally, the use of the expanded working fluid can allow for a space-saving configuration, wherein heat exchanger(s) 302 and/or 304 can be attached to compressor 20. As a result, a space-saving system can be realized with a reduced system footprint.

Thus, a compressor and refrigeration system according to the present teachings can advantageously utilize condensed working fluid that is subsequently expanded to reduce the temperature of the lubricant that flows through the compressor. The cooling of the lubricant can be coordinated with an economizer circuit that sub-cools the condensed working fluid. As a result, external cooling media or sources to cool the lubricant are not required. Additionally, a more compact design can be utilized by attaching the one or more heat exchanger(s) to the compressor. In some embodiments, a dual-system heat exchanger can be utilized to both sub-cool the condensed working fluid and cool the lubricant. In other embodiments, separate heat exchangers can be utilized. In some embodiments, expanded working fluid can be utilized without sub-cooling the condensed liquid working fluid line, wherein only the lubricant is cooled with the expanded working fluid. In all of these embodiments, the expanded working fluid that absorbs heat is injected into an intermediate-pressure location of the compressor. The reduction in the temperature of the lubricant can result in a lower injected lubricant temperature, which can reduce suction gas superheat, thereby improving compressor volumetric efficiency and improving performance. Additionally, the reduced lubricant temperature can improve compressor reliability due to the cooling of the suction gas and the motor, and maintain a desirable level of viscosity to achieve proper film thickness between moving parts of the compressor.

The incorporation of various machined surfaces into the shell of the compressor advantageously facilitates the precise alignment, both centering and axially, of various components within the compressor. The machining of the shell can be accomplished with a single setup thereby providing efficient manufacturing. Additionally, the machined surfaces are all round features that facilitate easy of machining. The components engaging with the machined surfaces of the shell may also be efficiently manufactured. Thus, the compressor may provide superior alignment and/or efficient manufacturing of the compressor.

The forming of an intermediate sump in the compressor between the main bearing support and the thrust plate can advantageously facilitate the lubricating of the orbiting scroll and related components. The thrust plate, the shell, and the main bearing support can define the intermediate sump. The inclusion of the counter weight on the crankshaft between the main bearing support and the orbiting scroll can advantageously travel through lubricant in the intermediate sump and splash and slosh the lubricant on the components in the area of the intermediate sump. A bypass groove can be machined into the shell to bypass the intermediate sump to allow lubricant to flow from the area of the motor (low side) to the lower scroll intake.

While the present invention is shown on a horizontal compressor with the motor within the shell, the invention can also be utilized in an open-drive compressor wherein the motor is external to the shell and drives a shaft that extends through the shell.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system comprising:

a compressor compressing a working fluid from a suction pressure to a discharge pressure greater than said suction pressure;

a lubricant lubricating said compressor;

a condenser condensing said working fluid discharged by said compressor;

an expansion device expanding said working fluid condensed by said condenser;

a first heat exchanger coil receiving said lubricant and being in heat transfer relation with expanded working fluid;

a second heat exchanger coil receiving condensed working fluid and being in heat transfer relation with said expanded working fluid; and a third heat exchanger coil receiving said expanded working fluid and a fourth heat exchanger coil receiving said expanded working fluid, wherein said first and third heat exchanger coils are disposed in a first heat exchanger transferring heat from said lubricant to said expanded working fluid and said second and fourth heat exchanger coils are disposed in a second heat exchanger transferring heat from said condensed working fluid to said expanded working fluid, wherein said expanded working fluid flows through said first heat exchanger after flowing through said second heat exchanger.

2. The system of claim 1, wherein said condensed working fluid is in a liquid state and said expanded working fluid is in one of a vapor state and a two-phase liquid and vapor state.

3. The system of claim 1, wherein said first, and second heat exchanger coils are disposed in a single heat exchanger unit that simultaneously transfers heat to said expanded working fluid from both said lubricant and said condensed working fluid, said expanded working fluid being received in a third heat exchanger coil disposed in said single heat exchanger unit.

4. The system of claim 3, wherein said single heat exchanger unit is mounted to said compressor.

5. The system of claim 1, further comprising an intermediate-pressure location in said compressor receiving expanded working fluid after heat is transferred between said expanded working fluid and at least one of said lubricant and said condensed working fluid.

6. The system of claim 1, wherein said compressor includes at least one of a high-side lubricant sump and a low-side lubricant sump.

7. The system of claim 6, wherein said compressor includes a shell, a compression mechanism, a bearing support, and a thrust plate, said low-side lubricant sump being defined by said thrust plate, said bearing support, and said shell.

8. The system of claim 6, wherein said first heat exchanger coil receives lubricant from said high-side lubricant sump.

9. The system of claim 6, wherein said compressor includes a crankshaft having a counterweight rotating with said crankshaft, said counterweight traveling through lubricant in said low-side lubricant sump during rotation of said crankshaft and splashing said lubricant therein.

10. The system of claim 1, wherein said compressor includes a single one-piece shell having axially opposite first and second ends, said shell including:

a main bearing support having a bore for supporting a portion of a crankshaft;

a continuous annular surface on an interior of said shell immediately adjacent said first end; and a plurality of axially extending arcuate surfaces adjacent said second end, said plurality of arcuate surfaces being circumscribingly spaced apart along said interior of said shell.

11. The system of claim 1, further comprising a separator disposed within said compressor and configured to separate said lubricant from said working fluid within said compressor.

12. An apparatus comprising:

a shell;

a compression mechanism disposed within said shell and compressing a working fluid;

a lubricant sump;

a first heat exchanger conduit receiving said working fluid discharged from said compression mechanism;

a second heat exchanger conduit receiving lubricant from said lubricant sump, said lubricant in said second heat exchanger conduit being in heat transfer relation with said working fluid;

a third heat exchanger conduit receiving said working fluid and in heat transfer relation with said working fluid in said first heat exchanger conduit; and a fourth heat exchanger conduit receiving said working fluid and in heat transfer relation with said working fluid in said second heat exchanger conduit, wherein said first and third heat exchanger conduits are disposed in a second heat exchanger transferring heat from condensed working fluid to expanded working fluid, and wherein said second and fourth heat exchanger conduits are disposed in a first heat exchanger transferring heat from said lubricant to expanded working fluid, and wherein said expanded working fluid flow through said first heat exchanger after flowing through said second heat exchanger.

13. The apparatus of claim 12, wherein said shell includes first and second inlets and first and second outlets, said compression mechanism receiving said working fluid at a first pressure from said first inlet and discharging working fluid at a second pressure that is higher than said first pressure through said first outlet, said lubricant sump being in communication with said second inlet and said second outlet.

14. The apparatus of claim 13, wherein said shell includes a third inlet receiving working fluid at an intermediate pressure that is greater than said first pressure and less than said second pressure.

15. The apparatus of claim 14, wherein said third inlet is in communication with said first heat exchanger conduit.

16. The apparatus of claim 14, wherein said compression mechanism includes an orbiting scroll and a non-orbiting scroll meshingly engaging said orbiting scroll to define a plurality of fluid pockets therebetween, said third inlet being in communication with at least one of said fluid pockets.

17. The apparatus of claim 12, wherein said second heat exchanger is mounted to said shell.

18. The apparatus of claim 12, wherein said first heat exchanger conduit receives expanded working fluid and said third heat exchanger conduit receives condensed working fluid.

19. The apparatus of claim 18, wherein said condensed working fluid is in a liquid state and said expanded working fluid is in one of a vapor state and a two-phase liquid and vapor state.

20. The apparatus of claim 12, wherein said lubricant sump is disposed within said shell.

21. A method comprising:

operating a compressor to compress a working fluid from a first pressure to a second pressure;

providing lubricant in said compressor;

separating said lubricant from said working fluid;

routing said working fluid and said lubricant through a first heat exchanger, said working fluid and at least a portion of said lubricant being fluidly isolated from each other in said first heat exchanger;

condensing said working fluid prior to routing said working fluid through said first heat exchanger;

expanding a first portion of said condensed working fluid prior to routing said working fluid through said first heat exchanger;

transferring heat between said lubricant and expanded working fluid in said first heat exchanger;

transferring heat from a second portion of said condensed working fluid to said expanded working fluid in a second heat exchanger, said second portion of said condensed working fluid being fluidly isolated from each other in said second heat exchanger;

routing said working fluid and said lubricant from said first heat exchanger to said compressor; and routing said expanded working fluid from said second heat exchanger to said first heat exchanger.

22. The method of claim 21, further comprising discharging said working fluid from said compressor through a first outlet in said compressor and discharging said lubricant from said compressor through a second outlet in said compressor.

23. The method of claim 21, wherein routing said working fluid to said compressor includes routing expanded working fluid to an intermediate-pressure location of said compressor.

24. The method of claim 21, wherein said lubricant is separated from said working fluid within said compressor.

* * * * *